US012391500B2

(12) United States Patent
Namiki et al.

(10) Patent No.: US 12,391,500 B2
(45) Date of Patent: Aug. 19, 2025

(54) MEDIUM FEEDING DEVICE AND IMAGE READING APPARATUS

(71) Applicant: SEIKO EPSON CORPORATION, Tokyo (JP)

(72) Inventors: Masaki Namiki, Kitakyushu (JP); Ryoichi Shuto, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 164 days.

(21) Appl. No.: 18/354,411

(22) Filed: Jul. 18, 2023

(65) Prior Publication Data

US 2024/0025685 A1 Jan. 25, 2024

(30) Foreign Application Priority Data

Jul. 19, 2022 (JP) ..... 2022-114810

(51) Int. Cl.
*B65H 9/06* (2006.01)
*B65H 3/34* (2006.01)
*B65H 3/56* (2006.01)

(52) U.S. Cl.
CPC ..... *B65H 9/06* (2013.01); *B65H 3/34* (2013.01); *B65H 3/56* (2013.01); *B65H 2301/331* (2013.01); *B65H 2301/42262* (2013.01); *B65H 2801/39* (2013.01)

(58) Field of Classification Search
CPC ..... B65H 9/06; B65H 3/34; B65H 3/56
See application file for complete search history.

(56) References Cited

U.S. PATENT DOCUMENTS

| | | | | |
|---|---|---|---|---|
| 9,193,549 | B2 * | 11/2015 | Fumoto | B65H 9/06 |
| 10,703,596 | B2 * | 7/2020 | Yoshita | B65H 3/0661 |
| 12,129,149 | B2 * | 10/2024 | Yoshita | B65H 9/06 |
| 2020/0071107 | A1 * | 3/2020 | Yoshita | B65H 9/06 |
| 2024/0140747 | A1 * | 5/2024 | Vu | B65H 9/06 |

FOREIGN PATENT DOCUMENTS

| | | | |
|---|---|---|---|
| JP | H0789643 | A * | 4/1995 |
| JP | 2014133640 | A * | 7/2014 |
| JP | 2020-037478 | A | 3/2020 |
| JP | 2023-112809 | | 8/2023 |
| JP | 2024-008357 | A | 1/2024 |

* cited by examiner

*Primary Examiner* — Patrick Cicchino
(74) *Attorney, Agent, or Firm* — WORKMAN NYDEGGER

(57) ABSTRACT

The medium feeding device includes a skew correction mechanism including a first lever member and a second lever member displaceable between an advanced position contactable with a document and a retracted position retracted from a transport path, and a first load member and a second load member displaceable between a blocking position at which a part of the transport path in a width direction is blocked and an opening position at which the transport path is opened without being blocked, and the first load member and the second load member overlap at least a part of a transport roller when seen in the width direction when they are located at the blocking position.

12 Claims, 26 Drawing Sheets

MEDIUM FEEDING DEVICE AND IMAGE READING APPARATUS

The present application is based on, and claims priority from JP Application Serial Number 2022-114810, filed Jul. 19, 2022, the disclosure of which is hereby incorporated by reference herein in its entirety.

BACKGROUND

1. Technical Field

The present disclosure relates to a medium feeding device and an image reading apparatus.

2. Related Art

In the related art, various medium feeding devices have been used. Among them, there is a medium transport device including a skew correction mechanism that corrects skew of a medium that is transported. For example, JP-A-2020-37478 discloses a medium transport device including a skew correction mechanism having a first stopper, a second stopper, a first lever, and a second lever in a transport path of a medium.

However, in the skew correction mechanism included in the medium transport device disclosed in JP-A-2020-37478, for example, when a medium having low stiffness such as a thin medium is used, there is a case in which skew correction accuracy is lowered. This is because the stiffness of the medium is lowered as a distance from a nipping position or the like of the medium by a medium transport unit increases, and in a skew correction mechanism or the like that corrects skew by causing a leading end of the medium in the transport direction to collide, as the distance increases, the medium is more likely to bend and the skew correction accuracy tends to decrease. For this reason, in the known medium transport device including the skew correction mechanism, it is a problem to improve the skew correction accuracy.

SUMMARY

In order to solve the above problem, a medium feeding device of the present disclosure includes a placement unit at which a medium is placed, a transport path along which the medium is transported, a feeding roller that feeds the medium placed at the placement unit, and a skew correction mechanism that corrects skew of the medium being fed, wherein the skew correction mechanism includes a first lever member and a second lever member that are displaceable between an advanced position at which the first lever member and the second lever member come into contact with the medium and are advanced into the transport path and a retracted position at which the first lever member and the second lever member are retracted from the transport path by the medium passing therethrough in contact therewith, and a first load member and a second load member that are provided downstream of the first lever member and the second lever member in a feeding direction of the medium and are displaceable between a blocking position at which a part of the transport path in a width direction that intersects the feeding direction is blocked and an opening position at which the transport path is open without being blocked, the feeding roller is provided between the first load member and the second load member in the width direction, the first load member and the second load member, when located at the blocking position, overlap at least a part of the feeding roller when seen in the width direction, the first load member is configured to be located at the blocking position when the first lever member is located at the advanced position and to be displaceable from the blocking position to the opening position when the first lever member is located at the retracted position, and the second load member is configured to be located at the blocking position when the second lever member is located at the advanced position and to be displaceable from the blocking position to the opening position when the second lever member is located at the retracted position.

BRIEF DESCRIPTION OF THE DRAWINGS

FIG. 18 is a diagram illustrating an operation of the set guide, in which

FIG. 19 is a diagram illustrating an operation of a set guide, in which

FIG. 20 is a diagram illustrating an operation of a pressing lever, in which

FIG. 24 is a diagram for describing the skew correction mechanism, in which

FIG. 25 is a diagram for describing the skew correction mechanism, in which FIG. 26 is a diagram for describing the skew correction mechanism, in which

DESCRIPTION OF EXEMPLARY EMBODIMENTS

Figure 1:
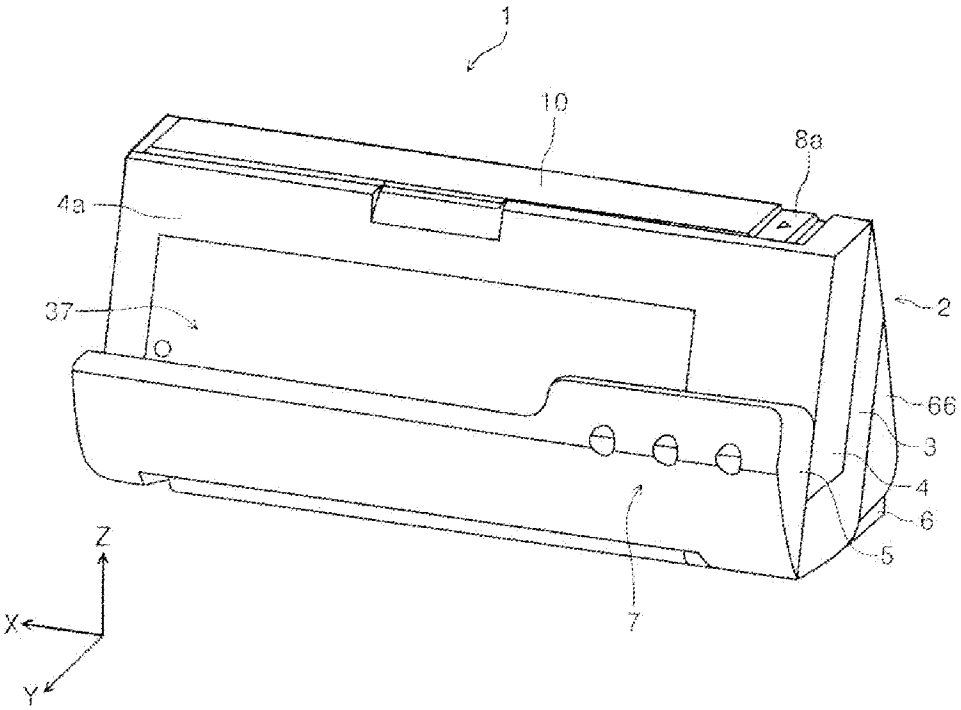
FIG. 1 is a front perspective view of a scanner in which a device main body is in a normal reading posture.

The present disclosure will be schematically described below.

A medium feeding device according to a first aspect of the present disclosure includes a placement unit at which a medium is placed, a transport path along which the medium is transported, a feeding roller that feeds the medium placed at the placement unit, and a skew correction mechanism that corrects skew of the medium being fed, wherein the skew correction mechanism includes a first lever member and a second lever member that are displaceable between an advanced position at which the first lever member and the second lever member come into contact with the medium and are advanced into the transport path and a retracted position at which the first lever member and the second lever member are retracted from the transport path by the medium passing therethrough in contact therewith, and a first load member and a second load member that are provided downstream of the first lever member and the second lever member in a feeding direction of the medium and are displaceable between a blocking position at which a part of the transport path in a width direction that intersects the feeding direction is blocked and an opening position at which the transport path is opened without being blocked, the feeding roller is provided between the first load member and the second load member in the width direction, the first load member and the second load member, when located at the blocking position, overlap at least a part of the feeding roller when seen in the width direction, the first load member is configured to be located at the blocking position when the first lever member is located at the advanced position and to be displaceable from the blocking position to the opening position when the first lever member is located at the retracted position, and the second load member is configured to be located at the blocking position when the second lever member is located at the advanced position and to be displaceable from the blocking position to the opening position when the second lever member is located at the retracted position.

According to the aspect, the first load member and the second load member, when located at the blocking position, overlap at least a part of the feeding roller when seen in the width direction. In other words, the skew correction mechanism is provided at a position not separated from the feeding roller in the feeding direction of the medium. Therefore, even when a medium having low stiffness such as a thin medium is used, the skew correction can be performed at a position at which the stiffness of the medium does not become low, and thus the skew correction can be performed while bending of the medium is curbed, and skew correction accuracy can be improved.

According to a second aspect of the present disclosure, in the medium feeding device according to the first aspect, a separation unit that is disposed to face the feeding roller and nips, when a plurality of the media are placed on top of each other at the placement unit, the media together with the feeding roller to separate the media is provided, wherein a contact position at which the first load member and the second load member located at the blocking position come into contact with the medium being transported and a nipping position between the feeding roller and the separation unit overlap each other when seen in the width direction.

According to the aspect, the separation unit that nips the medium together with the feeding roller and separates the medium is provided. Additionally, the contact position at which the first load member and the second load member located at the blocking position come into contact with the medium being transported and the nipping position between the feeding roller and the separation unit overlap each other when seen in the width direction. The stiffness of the medium increases as a distance from the nipping position between the feeding roller and the separation unit increases, and with such a configuration, the contact position and the nipping position are close to each other, and thus it is possible to perform the skew correction at a position at which the stiffness of the medium has not decreased. Therefore, it is possible to perform the skew correction while the bending of the medium is curbed, and it is possible to improve the skew correction accuracy.

According to a third aspect of the present disclosure, in the medium feeding device according to the first or second aspect, the first lever member and the second lever member, when located at the advanced position, overlap at least a part of the feeding roller when seen in the width direction.

According to the aspect, the first lever member and the second lever member, when located at the advanced position, overlap at least a part of the transport roller when seen in the width direction. That is, the first lever member and the second lever member can be disposed close to the first load member and the second load member in the transport direction. With such a configuration, it is possible to correct skew with high accuracy.

According to a fourth aspect of the present disclosure, in the medium feeding device according to the third aspect, the skew correction mechanism includes a first skew correction unit and a second skew correction unit in the width direction, the first skew correction unit includes the first lever member, a first contact portion displaceable between a first restriction position at which displacement of the first load member from the blocking position to the opening position is restricted and a first non-restriction position at which the restriction is released, and a first rotating shaft having one end provided with the first lever member and the other end provided with the first contact portion, the second skew correction unit includes a second contact portion displaceable between a second restriction position at which displacement of the second load member from the blocking position to the opening position is restricted and a second non-restriction position at which the restriction is released, and a second rotating shaft having one end provided with the second lever member and the other end provided with the second contact portion, the first contact portion is located at the first restriction position when the first lever member is located at the advanced position, and is located at the first non-restriction position when the first lever member is located at the retracted position, and the second contact portion is located at the second restriction position when the second lever member is located at the advanced position, and is located at the second non-restriction position when the second lever member is located at the retracted position.

According to the aspect, the first contact portion located at the first restriction position when the first lever member is located at the advanced position and located at the first non-restriction position when the first lever member is located at the retracted position, and the second contact portion located at the second restriction position when the second lever member is located at the advanced position and located at the second non-restriction position when the second lever member is located at the retracted position are provided. In this way, since a configuration in which movements of the lever member and the load member are not directly but indirectly interlocked with each other is adopted, it is possible to simply configure the skew correction mechanism.

According to a fifth aspect of the present disclosure, in the medium feeding device of the fourth aspect, the feeding roller is provided between the first lever member and the second load member, and the second lever member and the first load member in the width direction.

According to the aspect, the feeding roller is provided between the first lever member and the second load member and the second lever member and the first load member in the width direction. As described above, it is possible to effectively curb the skew becoming larger than a predetermined angle by linking the first lever member and the first load member and linking the second lever member and the second load member, which are separated from each other in the width direction. In addition, it is possible to effectively correct skew even with respect to a medium having a narrow width by adopting a configuration in which a link destination of the load member with respect to the lever member straddles the feeding roller.

According to a sixth aspect of the present disclosure, in the medium feeding device of the fifth aspect, the first lever member is provided at a position overlapping at least a part of the second load member in the feeding direction, and the second lever member is provided at a position overlapping at least a part of the first load member in the feeding direction.

According to the aspect, the first lever member is provided at a position overlapping at least a part of the second load member in the feeding direction, and the second lever member is provided at a position overlapping at least a part of the first load member in the feeding direction. With such a configuration, it is possible to shorten a distance between the lever member and the load member in the width direction, and for example, it is possible to particularly effectively correct skew for a medium having a narrow width, for example.

According to a seventh aspect of the present disclosure, in the medium feeding device of the fourth aspect, the feeding roller is provided between the first lever member and the first load member, and the second lever member and the second load member in the width direction.

According to the aspect, the feeding roller is provided between the first lever member and the first load member and the second lever member and the second load member in the width direction. In this way, it is possible to reduce a size of a link mechanism between the lever member and the load member by linking the first lever member and the first load member and linking the second lever member and the second load member, which are close to each other in the width direction.

According to an eighth aspect of the present disclosure, in the medium feeding device according to the first aspect, the medium feeding device further includes a separation unit that is disposed to face the feeding roller and nips, when a plurality of the media are placed on top of each other at the placement unit, the media together with the feeding roller to separate the media, and a set guide that guides a leading end of the medium placed at the placement unit to a nipping position between the feeding roller and the separation unit, wherein the set guide is capable of adjusting a distance between the separation unit and the feeding roller according to a thickness of the medium, and the skew correction mechanism is provided in the set guide.

According to the aspect, the set guide capable of adjusting the distance between the separation unit and the feeding roller according to the thickness of the medium is provided. Since the distance between the separation unit and the feeding roller is adjusted according to the thickness of the medium, for example, it is possible to curb a situation in which a medium having a thickness exceeding a predetermined thickness collides with the separation unit and cannot be fed. Further, the skew correction mechanism is provided in the set guide. Since the set guide and the skew correction mechanism are integrated as described above, it is possible to reduce a size of a medium transport device.

According to a ninth aspect of the present disclosure, in the medium feeding device of the eighth aspect, the set guide includes a pressing lever disposed upstream of the nipping position in the feeding direction, provided at both ends of the feeding roller in the width direction at positions closer to the feeding roller than the skew correction mechanism, and capable of switching between a first position for pressing on the feeding roller and a second position for separating from the feeding roller by advancing and retracting with respect to the feeding roller, and the pressing lever is configured to, after a trailing end in the feeding direction of a preceding medium separated by the separation unit and fed in advance among the plurality of media placed on top of each other at the second position passes through the nipping position, press a following medium other than the preceding medium among the plurality of media placed on top of each other at the first position against the feeding roller.

According to the aspect, the medium feeding device further includes the pressing lever configured to be capable of pressing a following medium other than a preceding medium among the plurality of media placed on top of each other at the first position, at which the pressing lever presses the feeding roller, against the feeding roller after the trailing end in the feeding direction of the preceding medium separated by the separation unit and fed in advance among the plurality of media placed on top of each other at the second position separated from the feeding roller passes through the nipping position. Thus, it is possible to curb the following medium being strongly returned toward the upstream side in the feeding direction after the preceding medium is fed.

According to a tenth aspect of the present disclosure, in the medium feeding device according to the eighth or ninth aspect, the medium feeding device further includes a path member that is disposed in at least a part of a periphery of the separation unit to be openable and closable, is provided so that the separation unit is detachable when the path member is in an open state, and forms at least a part of the transport path when the path member is in a closed state, and the set guide is provided at the path member.

According to the aspect, the path member is provided so that the separation unit is detachable when the path member is in the open state, and forms at least a part of the transport path when the path member is in the closed state. Thus, it is possible to easily replace the separation unit or the like by bringing the path member into the open state.

An image reading apparatus according to an eleventh aspect includes the medium feeding device according to any one of the first to tenth aspects, and a reading unit configured to read an image on the medium transported on the transport path.

According to the aspect, in the image reading apparatus, the effect of any one of the first to tenth aspects described above can be obtained.

The present disclosure will be specifically described below.

Hereinafter, as an example of the image reading apparatus, a scanner 1 capable of reading at least one surface of a first surface and a second surface opposite to the first surface of a document will be described. The scanner 1 is a so-called sheet-feed type scanner that reads a document while the document is moved with respect to a reading unit described below. In this specification, the document includes not only a sheet-like document but also a card-like document and a booklet-like document. A document is an example of a medium.

In an XYZ coordinate system illustrated in each of drawings, an X-axis direction is a width direction of a device and a width direction of a document. A Y-axis direction is a depth direction of the device, and a Z-axis direction is a direction along a vertical direction. In the embodiment, a +Y direction is a direction from a rear surface to a front surface of the device, and a −Y direction is a direction from the front surface to the rear surface of the device. Also, a left direction when seen from the front surface of the device is a +X direction, and a right direction is a −X direction. Also, hereinafter, a direction in which the document is transported may be referred to as "downstream", and a direction opposite thereto may be referred to as "upstream".

The scanner 1 of the embodiment includes a document feeding device 150 which is an example of a medium feeding device. In the embodiment, the document feeding device 150 has a configuration in which a first reading unit 32 and a second reading unit 33 described below are removed from the scanner 1. However, from the viewpoint of feeding the document in the scanner 1, the entire scanner 1 including the first reading unit 32 and the second reading unit 33 may be the document feeding device 150. In addition, the scanner 1 can be regarded as a medium transport device because the scanner 1 transports a document therein. The scanner 1 according to the embodiment includes a device main body 2 and a main body support unit 6 that rotatably supports the device main body 2. The device main body 2 includes a first unit 3, a second unit 4, and a third unit 5.

Figure 3:
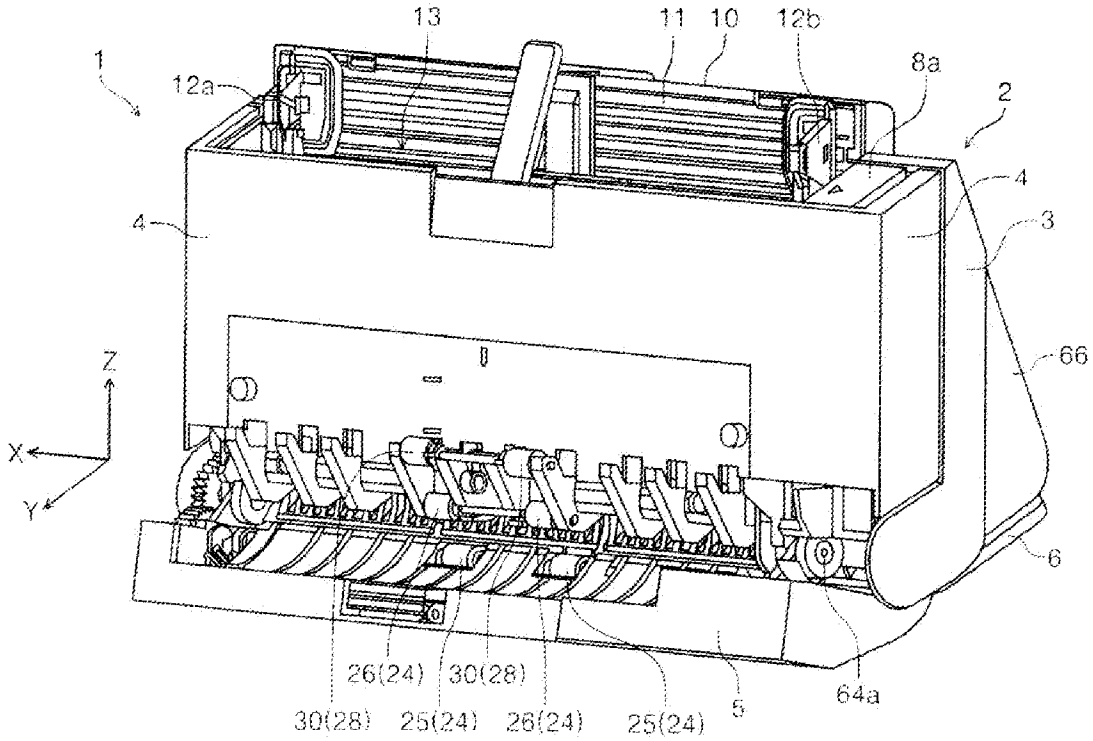
FIG. 3 is a front perspective view of the scanner in which the device main body is in the normal reading posture and a third unit is open.
Figure 5:
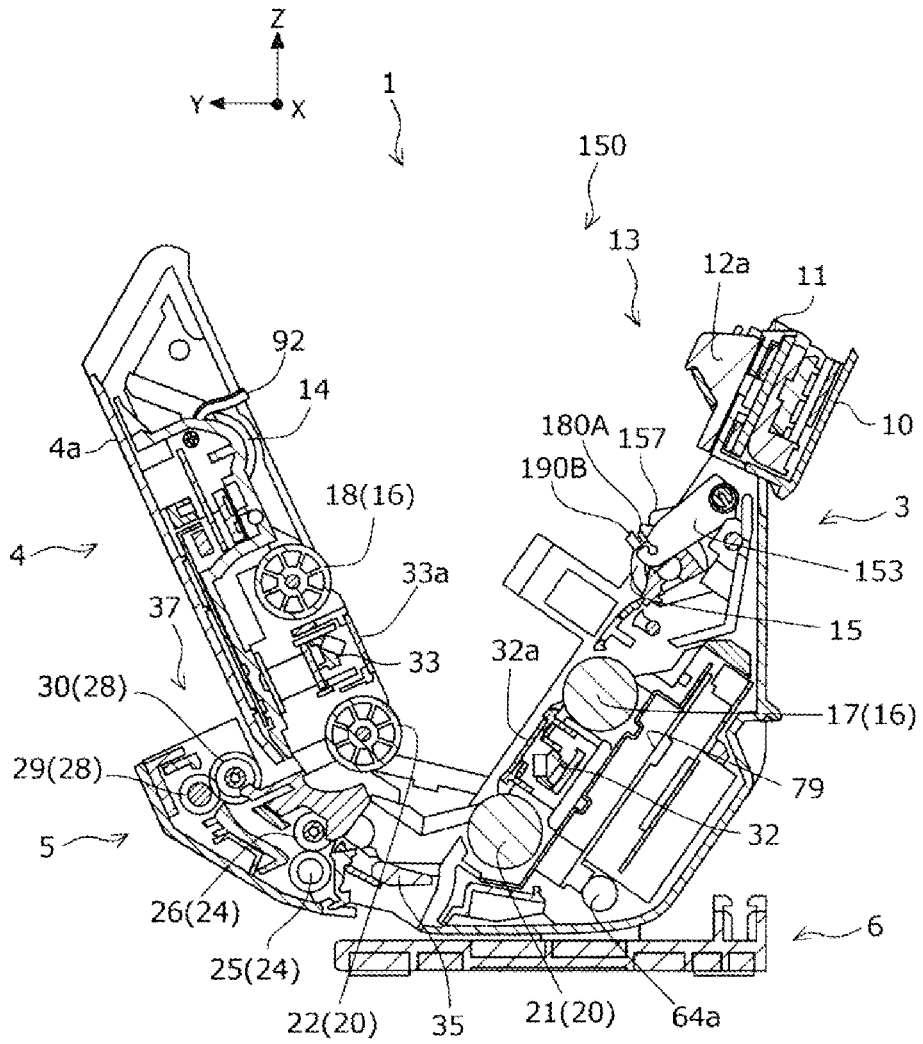
FIG. 5 is a cross-sectional view of the scanner in which the device main body is in the normal reading posture and a second unit is open with respect to the first unit when seen in a width direction.

The second unit 4 and the third unit 5 are provided to be rotatable about a frame rotating shaft 64*a* (refer to FIG. 3). The frame rotating shaft 64*a* is a rotating shaft having a rotation axis center parallel to the X-axis direction. The second unit 4 and the third unit 5 can integrally rotate about the frame rotating shaft 64*a* with respect to the first unit 3 (refer to FIG. 5). A part of a document transport path (a transport path of the document P) can be exposed by rotating the second unit 4 and the third unit 5 with respect to the first unit 3, as illustrated in FIG. 5. In particular, a document feeding path R1 and a reading transport path R2 which will be described below can be exposed. A user can unlock the second unit 4 from the first unit 3 by sliding an unlocking unit 8*a* in the −X direction and thus can open the second unit 4.

Further, the third unit 5 can rotate about the frame rotating shaft 64*a* with respect to the first unit 3 and the second unit 4 (refer to FIG. 3). A part of the document transport path can be exposed by rotating the third unit 5 with respect to the first unit 3 and the second unit 4, as illustrated in FIG. 3. In particular, a reverse transport path R3 which will be described below can be exposed.

Figure 6:
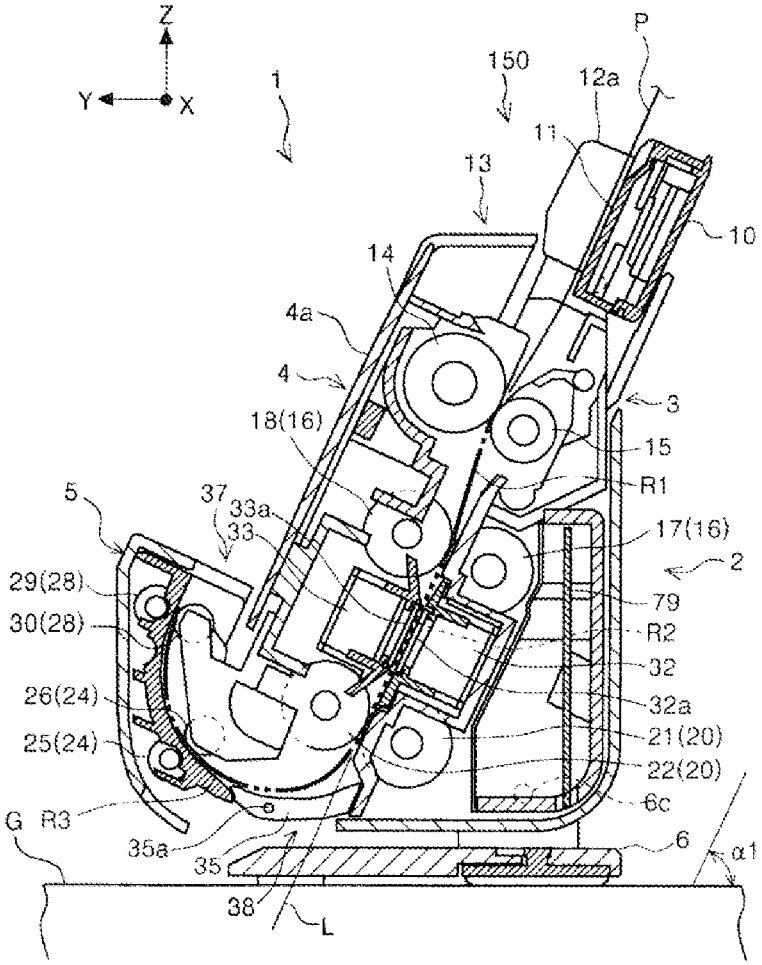
FIG. 6 is a cross-sectional view of a document transport path of the scanner in which the device main body is in the normal reading posture when seen in a width direction.
Figure 7:
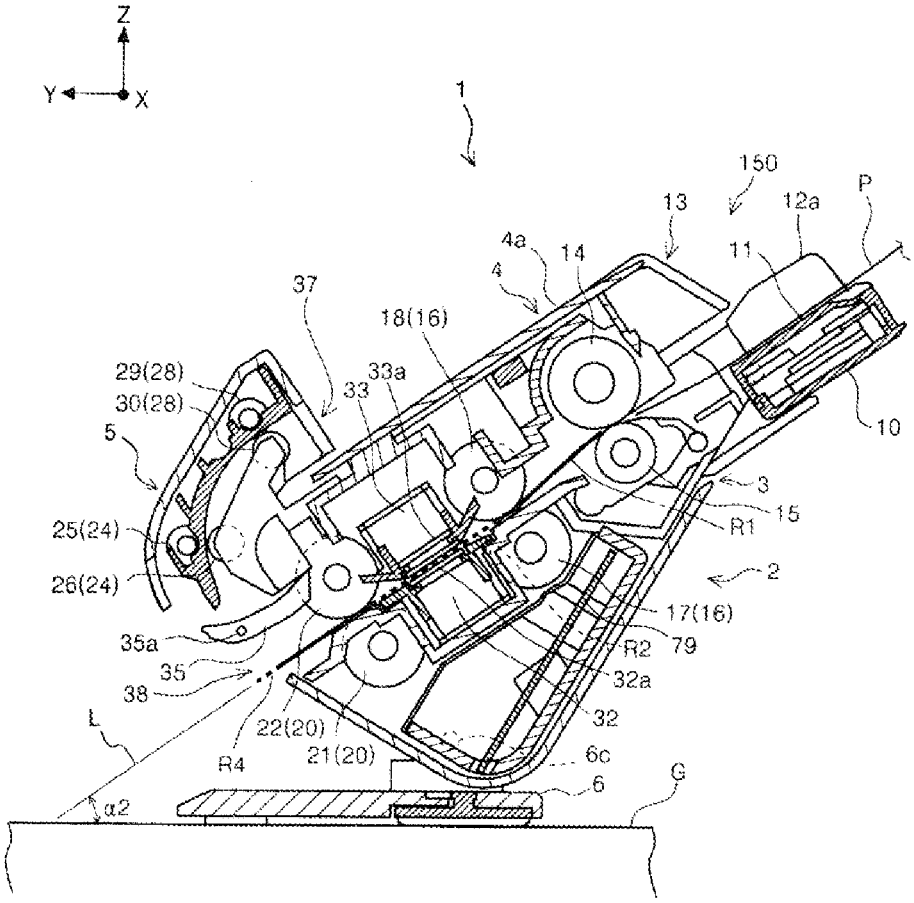
FIG. 7 is a cross-sectional view of the document transport path of the scanner in which the device main body is in a booklet reading posture when seen in the width direction.

The device main body 2 is rotatable about a main body rotating shaft 6*c* (refer to FIG. 8) with respect to the main body support unit 6, and in the embodiment, the device main body 2 can hold two postures by rotating. The two postures of the device main body 2 are illustrated in FIGS. 6 and 7, and hereinafter, the posture illustrated in FIG. 6 is referred to as a normal reading posture and the posture illustrated in FIG. 7 is referred to as a booklet reading posture. The normal reading posture is an example of a first posture of the device main body 2, and the booklet reading posture is an example of a second posture of the device main body 2. FIGS. 6 and 7 are cross-sectional views taken at the same position in the X-axis direction, but FIG. 5 is a cross-sectional view taken at a different position in the X-axis direction from FIGS. 6 and 7.

An angle $\alpha 1$ illustrated in FIG. 6 and an angle $\alpha 2$ illustrated in FIG. 7 are angles formed by an extension line L of a reading transport path R2 and a placement surface G of the device which will be described below. The angle $\alpha 2$ in the booklet reading posture is smaller than the angle $\alpha 1$ in the normal reading posture. In the normal reading posture, a projection area of the device main body 2 on the placement surface G on which the scanner 1 is placed is minimized, that is, a footprint of the device main body 2 is minimized. The footprint in this specification is an area occupied by the device main body 2 in an X-Y plane when the device main body 2 is seen from above. The normal reading posture is suitable for reading a sheet-like document, that is, a document which has low rigidity and is easily bent. The booklet reading posture is suitable for reading a document such as a plastic card or a booklet which has high rigidity and is not easily bent.

Figure 2:
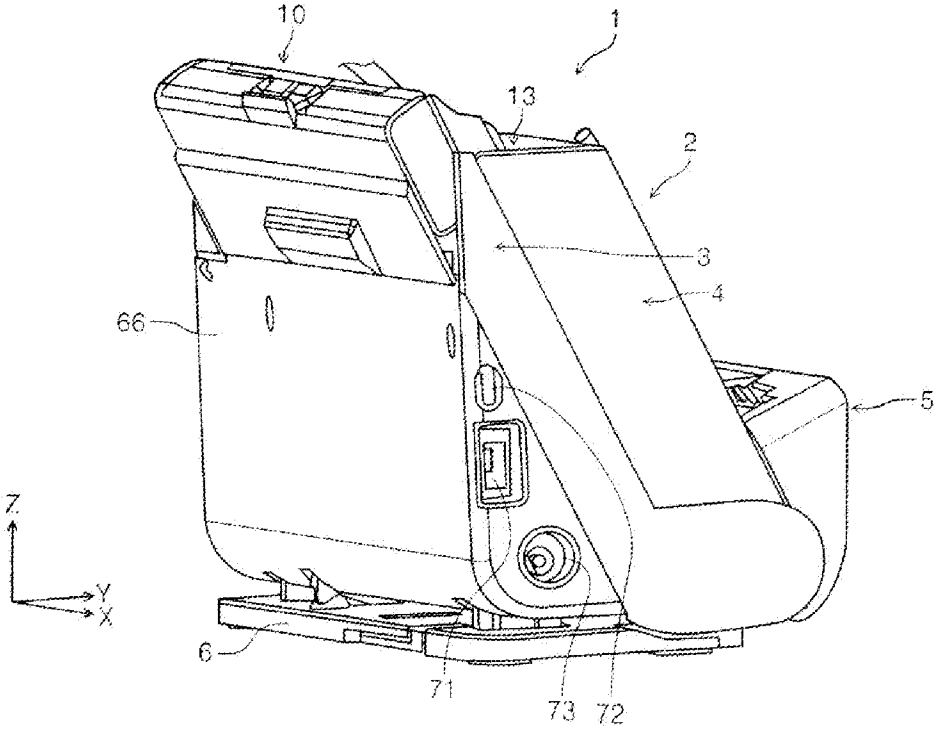
FIG. 2 is a rear perspective view of the scanner in which the device main body is in the normal reading posture.

An operation unit 7 including a plurality of operation buttons including a power button is provided on the front surface of the device. As illustrated in FIG. 2, a first coupling unit 71, a second coupling unit 72, and a third coupling unit 73 are provided on a side surface in the +X direction among side surfaces constituting the periphery of the device. The first coupling unit 71 is a coupling unit to which a plug of a USB Type-A (not illustrated) which is an example of a coupling target is coupled. The second coupling unit 72 is a coupling unit to which a plug of a USB Type-C (not illustrated) which is an example of a coupling target is coupled. The third coupling unit 73 is a coupling unit to which a power supply plug (not illustrated) for supplying power to the device main body 2 is coupled. USB is an abbreviation of Universal Serial Bus, and each of the Type-A and the Type-C is one of a plurality of types defined in the USB standard.

An external device can be coupled via a USB cable (not illustrated), and a storage medium, for example, a USB memory (not illustrated) can be coupled to the first coupling unit 71. A control unit 80 (refer to FIG. 9) can store read data in the storage medium coupled to the first coupling unit 71. Further, an external device can be coupled to the second coupling unit 72 via a USB cable (not illustrated). The first coupling unit 71, the second coupling unit 72, and the third coupling unit 73 are provided on a circuit board 79 (refer to FIG. 8) located on the rear surface side of the device. In the embodiment, the device main body 2 is configured to be able to receive power supply from an external device coupled to the second coupling unit 72.

Next, a configuration of the document transport path in the scanner 1 will be described with reference to FIGS. 6 and 7. A fed document is supported in an inclined posture by a document support unit 11. A reference character P denotes a document to be supported. When a plurality of documents are supported by the document support unit 11, the uppermost document is fed downstream by a feeding roller 14. The feeding roller 14 comes into contact with an upper surface of the document supported by the document support unit 11. The document support unit 11 is formed in an upper opening and closing unit 10. The upper opening and closing unit 10 is rotatable about a rotating shaft (not illustrated), and rotates to open and close a feeding port 13. FIG. 1 illustrates a state in which the upper opening and closing unit 10 is closed, and FIG. 2 illustrates a state in which the upper opening and closing unit 10 is open. The upper opening and closing unit 10 constitutes the first unit 3.

Figure 4:
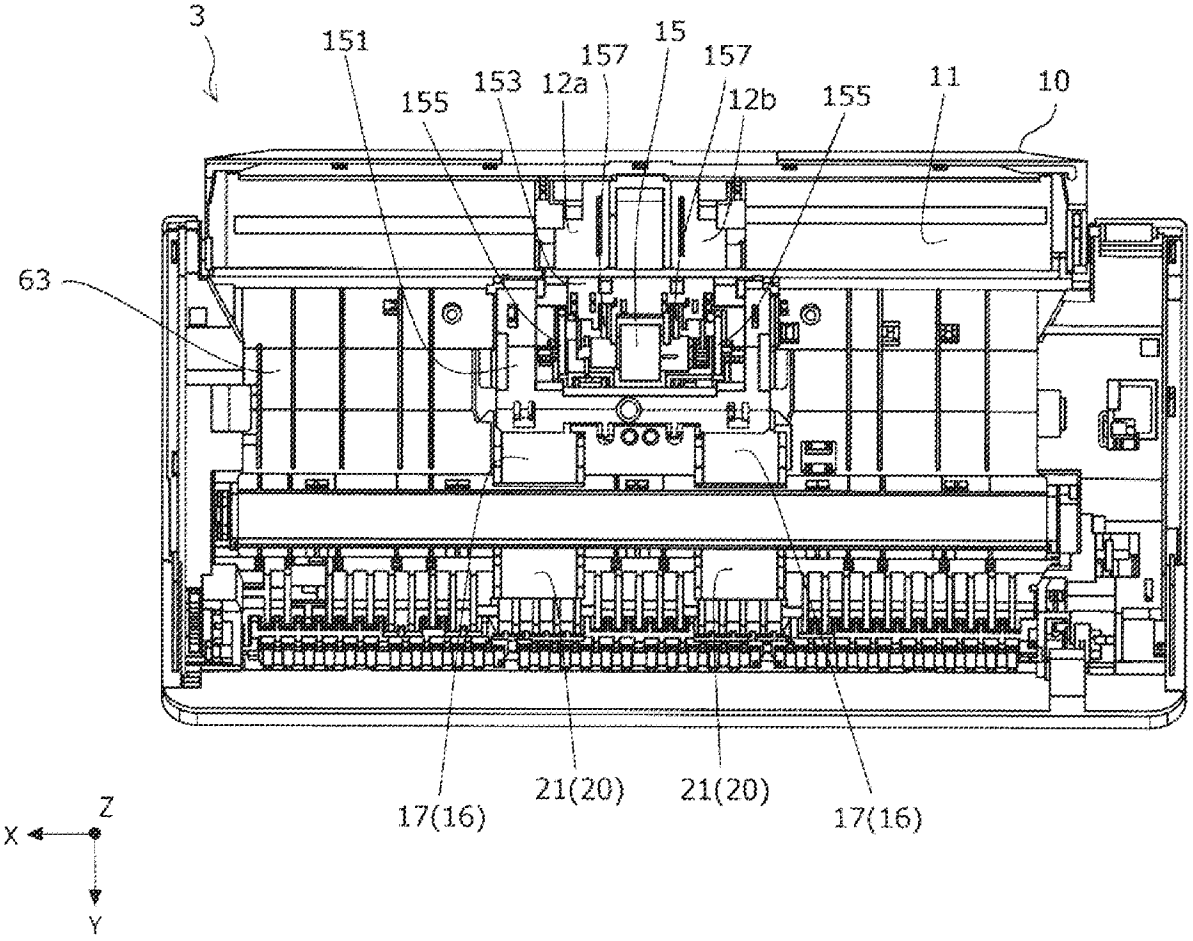
FIG. 4 is a plan view of a first unit seen from above when the device main body is in the normal reading posture.

As illustrated in FIGS. 3 and 4, a pair of edge guides 12*a* and 12*b* for guiding side edges of the document are provided at the document support unit 11. The pair of edge guides 12*a* and 12*b* are provided to be slidable in a width direction (the X-axis direction) of the document. The pair of edge guides 12*a* and 12*b* are interlocked by a rack and pinion mechanism (not illustrated) to be spaced apart from each other or to approach each other while a center position in the width direction of the document is sandwiched therebetween. That is, the scanner 1 adopts a so-called center feeding system.

The feeding roller 14 is provided in the second unit 4. When the second unit 4 is closed with respect to the first unit 3, the feeding roller 14 comes into contact with a separation roller 15 described below. When the second unit 4 is opened with respect to the first unit 3, the feeding roller 14 is spaced apart from the separation roller 15. The feeding roller 14 rotates by obtaining power from a transport motor 50 described below. The separation roller 15 is provided at a position facing the feeding roller 14 in the first unit 3. A rotational torque is applied to the separation roller 15 by a torque limiter (not illustrated), and the separation roller 15 curbs double feeding of the documents. A separation pad may be employed instead of the separation roller 15. The separation roller 15 is provided at a center position in the width direction of the document (refer to FIG. 4). In addition, the feeding roller 14 provided at a position facing the separation roller 15 is also provided at the center position in the width direction of the document.

The separation roller 15 which is an example of a separation unit disposed to face the feeding roller 14 is capable of advancing and retracting with respect to the feeding roller 14, and is capable of taking a separation state in which a rotational torque is generated by an action of a torque limiter (not illustrated) and separation of the document can be performed and a non-separation state in which the action of the torque limiter is not generated and the separation of the document is not performed. When the device main body 2 is in the normal reading posture, the separation roller 15 is in the separation state, and when the device main body 2 is in the booklet reading posture, the separation roller 15 is in the non-separation state.

A first transport roller pair 16 is provided downstream of the feeding roller 14 and the separation roller 15. The first transport roller pair 16 includes a first lower roller 17 provided in the first unit 3 and a first upper roller 18 provided in the second unit 4. The first upper roller 18 is provided to advance and retract with respect to the first lower roller 17, and is pressed toward the first lower roller 17 by a pressing member (not illustrated), for example, a coil spring. Both the first lower roller 17 and the first upper roller 18 rotate by obtaining power from a transport motor 50 described below. Two first lower rollers 17 and two first upper rollers 18 are provided to sandwich the center position in the width direction of the document (refer to FIG. 4). When the second unit 4 is closed with respect to the first unit 3, the first lower roller 17 and the first upper roller 18 come into contact with each other. When the second unit 4 is opened with respect to the first unit 3, the first upper roller 18 is spaced apart from the first lower roller 17 (refer to FIG. 5).

A first reading unit 32 and a second reading unit 33 are disposed downstream of the first transport roller pair 16 to face each other. The first reading unit 32 is provided in the first unit 3, and the second reading unit 33 is provided in the second unit 4. The first reading unit 32 reads a lower surface (a first surface) of the document supported by the document support unit 11, and the second reading unit 33 reads an upper surface (a second surface) of the document supported by the document support unit 11. The second reading unit 33 is provided to advance and retract with respect to the first reading unit 32, and is pressed toward the first reading unit 32 by a pressing member (not illustrated), for example, a coil spring. In the embodiment, the first reading unit 32 and the second reading unit 33 are each configured of a contact image sensor module (CISM). A reference numeral 32*a* denotes a contact glass constituting the first reading unit 32, and a reference numeral 33*a* denotes a contact glass constituting the second reading unit 33.

A second transport roller pair 20 is provided downstream of the first reading unit 32 and the second reading unit 33. The second transport roller pair 20 includes a second lower roller 21 provided in the first unit 3 and a second upper roller 22 provided in the second unit 4. The second upper roller 22 is provided to be capable of advancing and retracting with respect to the second lower roller 21, and is pressed toward the second lower roller 21 by a pressing member (not illustrated), for example, a coil spring. Both the second lower roller 21 and the second upper roller 22 rotate by obtaining power from the transport motor 50 described below. Two second lower rollers 21 and two second upper rollers 22 are provided to sandwich the center position in the width direction of the document (refer to FIG. 4). When the second unit 4 is closed with respect to the first unit 3, the second lower roller 21 and the second upper roller 22 come into contact with each other. When the second unit 4 is opened with respect to the first unit 3, the second upper roller 22 is spaced apart from the second lower roller 21 (refer to FIG. 5).

In FIGS. 6 and 7, an alternate long and short dash line indicated by a reference numeral R1 is a document feeding path, and the document feeding path R1 extends from a nipping position between the feeding roller 14 and the separation roller 15 to a nipping position of the first transport roller pair 16. Further, in FIGS. 6 and 7, a broken line indicated by a reference numeral R2 is a reading transport path, and the reading transport path R2 extends from a nipping position of the first transport roller pair 16 to a nipping position of the second transport roller pair 20. The reading transport path R2 is a document transport path facing the first reading unit 32 and the second reading unit 33.

When the device main body 2 is in the normal reading posture illustrated in FIG. 6, a reverse transport path R3 for reversing the read document upward and discharging the document is formed downstream of the reading transport path R2. The reverse transport path R3 is a document transport path located downstream of the nipping position of the second transport roller pair 20, and is a document transport path for bending and reversing a document transported obliquely downward as indicated by a two dot chain line in FIG. 6 and discharging the document obliquely upward from a first discharge port 37. When the device main body 2 is in the booklet reading posture illustrated in FIG. 7, a non-reverse transport path R4 for discharging a read document without reversing the document is formed downstream of the reading transport path R2. The non-reverse transport path R4 is a document transport path located downstream of the nipping position of the second transport roller pair 20, and is a document transport path for discharging a document transported obliquely downward in the reading transport path R2 as indicated by a two dot chain line in FIG. 7 obliquely downward from a second discharge port 38 without bending and reversing the document. The second transport roller pair 20 functions as a discharge roller pair that discharges the document from the non-reverse transport path R4.

Switching between the reverse transport path R3 and the non-reverse transport path R4 is performed by a flap 35 as a flap member constituting a transport path switching unit. The flap 35 is rotatable about a flap rotating shaft 35*a*, and when the flap 35 rotates, the reverse transport path R3 is coupled to the reading transport path R2 or the non-reverse transport path R4 is coupled to the reading transport path R2. Coupling the reverse transport path R3 to the reading transport path R2 means making the reverse transport path R3 available and also means making the non-reverse transport path R4 unavailable. Similarly, coupling the non-reverse transport path R4 to the reading transport path R2 means making the non-reverse transport path R4 available and also means making the reverse transport path R3 unavailable.

In the embodiment, the flap 35 is configured to rotate in conjunction with switching of the posture of the device main body 2. In the embodiment, a first solenoid 86 (refer to FIG. 9) is employed as a configuration for rotating the flap 35 in conjunction with switching of the posture of the device main body 2. A control unit 80 (refer to FIG. 9) that performs various controls detects the posture of the device main body 2 based on a detection signal of a first posture detection sensor 87 or a second posture detection sensor 88 which will be described below, and drives the first solenoid 86 based on the detected posture to rotate the flap 35. A means for rotating the flap 35 is not limited to the first solenoid 86, but may be another actuator such as a motor. Alternatively, the flap 35 may be configured to mechanically rotate in conjunction with the posture of the device main body 2.

A third transport roller pair 24 and a fourth transport roller pair 28 are provided on the reverse transport path R3. The third transport roller pair 24 includes a third driving roller 25 provided in the third unit 5 and a third driven roller 26 provided in the second unit 4. The third driven roller 26 is provided to be capable of advancing and retracting with respect to the third driving roller 25, and is pressed toward the third driving roller 25 by a pressing member (not illustrated), for example, a coil spring. The third driving roller 25 is driven by the transport motor 50. The third driven roller 26 is a roller that is driven to rotate.

The fourth transport roller pair 28 includes a fourth driving roller 29 provided in the third unit 5 and a fourth driven roller 30 provided in the second unit 4. The fourth driven roller 30 is provided to be capable of advancing and retracting with respect to the fourth driving roller 29, and is pressed toward the fourth driving roller 29 by a pressing member (not illustrated), for example, a coil spring. The fourth driving roller 29 is driven by the transport motor 50. The fourth driven roller 30 is a roller that is driven to rotate.

Two third driving rollers 25, two third driven rollers 26, two fourth driving rollers 29, and two fourth driven rollers 30 are provided to sandwich the center position in the width direction of the document (refer to FIG. 3). When the third unit 5 is closed with respect to the second unit 4, the third driving roller 25 and the third driven roller 26 come into contact with each other, and the fourth driving roller 29 and the fourth driven roller 30 also come into contact with each other. When the third unit 5 is opened with respect to the second unit 4, the third driving roller 25 and the third driven roller 26 are spaced apart from each other, and the fourth driving roller 29 and the fourth driven roller 30 are also spaced apart from each other.

The document transported on the reverse transport path R3 is discharged obliquely upward including a −Y direction component by the fourth transport roller pair 28, and is supported in an inclined posture by an upper surface 4*a* of the second unit 4.

Figure 8:
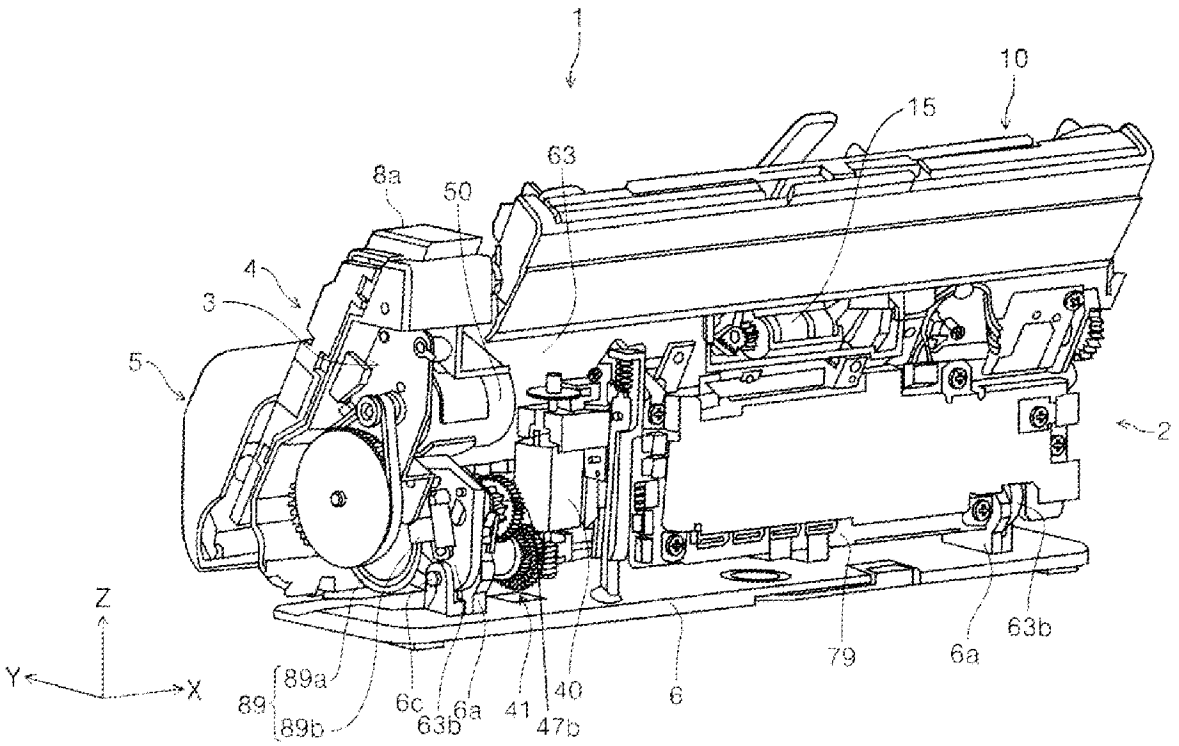
FIG. 8 is a rear perspective view of the scanner in which a rear cover of the first unit is removed.

In the embodiment, the device main body 2 is rotated by the power of a posture switching motor 40 (refer to FIG. 8) under the control of the control unit 80, and switches the posture. The control unit 80 controls the posture switching motor 40 based on input information from an external device 500 coupled to the scanner 1. FIG. 8 illustrates a state in which a back cover 66 (refer to FIG. 2) constituting an exterior of the back of the device is removed. A reference numeral 41 denotes a rotation conversion unit that converts rotation of the posture switching motor 40 into rotation of the device main body 2. The posture switching motor 40 and the rotation conversion unit 41 are provided close to a side surface in the −X direction in the width direction of the device. Being closer to the side surface in the −X direction in the width direction of the device means being located in the −X direction from the center position of the device in the X-axis direction.

Two supported units 63*b* are provided in a first frame 63 constituting a base body of the first unit 3 to be spaced apart from each other in the X-axis direction. Two main body rotating shafts 6*c* are provided in the main body support unit 6 to be spaced apart from each other in the X-axis direction. The first frame 63, that is, the device main body 2 is rotatable about the main body rotating shaft 6*c* by the main body rotating shaft 6*c* passing through the supported unit 63*b*. The main body rotating shaft 6*c* is a rotating shaft having a rotation axis center parallel to the X-axis direction.

The posture switching motor 40 is provided on the first frame 63. The first frame 63 has a shape along the reading transport path R2. The posture switching motor 40 is provided on the back surface side of the first frame 63 provided in an inclined posture. The rotation conversion unit 41 includes a gear 47*b* rotatably provided in the first unit 3 and rotated by the power of the posture switching motor 40, and a standing wall portion 6*a* fixed to the main body support unit 6 and having a tooth portion meshing with the gear 47*b*. The tooth portion is formed around the main body rotating shaft 6*c* of the standing wall portion 6*a*.

The configuration of the posture switching motor 40 and the above-described rotation conversion unit 41 except for the tooth portion of the standing wall portion 6*a* is provided in the first unit 3, that is, the device main body 2. Therefore, when the gear 47*b* is rotated by the power of the posture switching motor 40, the device main body 2 is rotated and the posture is switched.

The control unit 80 (refer to FIG. 9) can detect the posture of the device main body 2 based on a rotation direction of the posture switching motor 40 or the like. However, in the embodiment, since a first posture detection sensor 87 and a second posture detection sensor 88 which will be described below are provided, the control unit 80 can also detect the posture of the device main body 2 based on detection signals of the sensors. The normal reading posture and the booklet reading posture of the device main body 2 are held by supplying electric power to the posture switching motor 40 which is stopped and bringing the posture switching motor 40 into a hold state.

In the above-described embodiment, although the posture of the device main body 2 is switched by the power of the posture switching motor 40, instead thereof or in addition thereto, a configuration in which the posture of the device main body 2 is switched by the user applying a force to the device main body 2 may be adopted.

Figure 9:
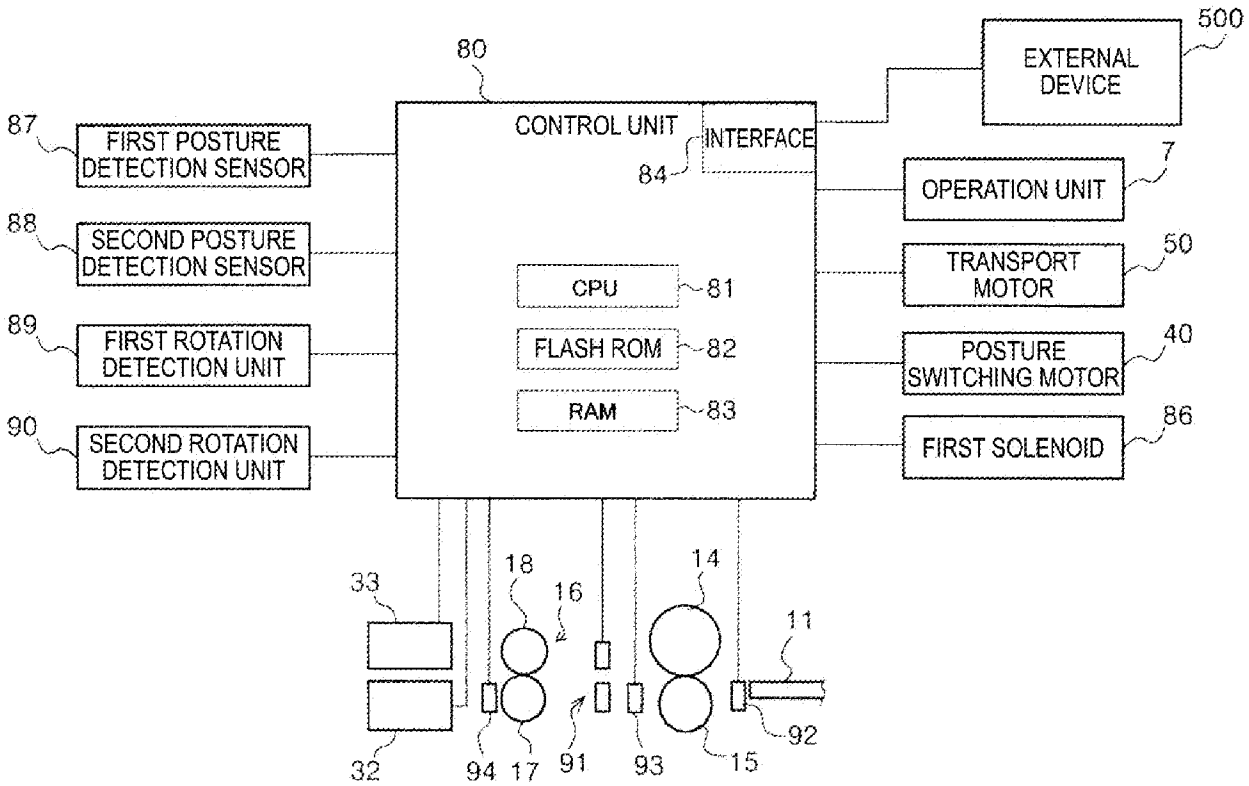
FIG. 9 is a block diagram illustrating a control system of the scanner.

Next, a control system in the scanner 1 will be described with reference to FIG. 9. The control unit 80 performs various types of control of the scanner 1, including document feeding, transport, discharge control, and reading control. A signal from the operation unit 7 is input to the control unit 80.

The control unit 80 controls the transport motor 50 and the posture switching motor 40. In the embodiment, each of the motors is a DC motor. Read data from the first reading unit 32 and the second reading unit 33 is input to the control unit 80, and a signal for controlling each of the reading units is transmitted from the control unit 80 to each of the reading units. Signals from detection unit including a placement detection unit 92 (refer to FIG. 5), a double feed detection unit 91, a first document detection unit 93, a second document detection unit 94, a first posture detection sensor 87, a second posture detection sensor 88, a first rotation detection unit 89, and a second rotation detection unit 90 are also input to the control unit 80.

As illustrated in FIG. 8, the first rotation detection unit 89 is a detection unit provided at an end portion of the device main body 2 in the −X direction. The control unit 80 can grasp an amount of rotation of each of the rollers provided in the document transport path by detecting an amount of rotation of the transport motor 50 with the first rotation detection unit 89. The first rotation detection unit 89 is a rotary encoder including a rotary disk 89*a* and a detection unit 89*b*. Further, the second rotation detection unit 90 is a rotary encoder including a rotary disk provided on a rotating shaft 40*a* of the posture switching motor 40 and a detection unit. The control unit 80 can grasp the rotation direction and the amount of rotation of the posture switching motor 40 by detecting the amount of rotation of the posture switching motor 40 with the second rotation detection unit 90.

The control unit 80 includes a CPU 81, a flash ROM 82, and a RAM 83. The CPU 81 performs various types of operation processing according to a program stored in the flash ROM 82, and controls an operation of the entire scanner 1. The flash ROM 82 which is an example of a storage unit is a readable and writable non-volatile memory. The RAM 83 which is an example of a storage unit temporarily stores various types of information. An interface 84 included in the control unit 80 includes the first coupling unit 71 and the second coupling unit 72 described with reference to FIG. 2. The control unit 80 transmits and receives data to and from an external device 500 via the interface 84.

Next, other detection units will be described. The placement detection unit 92 is a detection unit provided upstream of the feeding roller 14. The control unit 80 can detect the presence or absence of a document on the document support unit 11 based on a signal transmitted from the placement detection unit 92. The first document detection unit 93 is a detection unit provided between the feeding roller 14 and the first transport roller pair 16. The control unit 80 can detect passage of the leading end or the trailing end of the document at a detection position based on a signal transmitted from the first document detection unit 93.

The double feed detection unit 91 is a detection unit provided between the feeding roller 14 and the first transport roller pair 16, and includes an ultrasonic transmitting unit and an ultrasonic receiving unit which are disposed to face each other across the document feeding path R1. The control unit 80 can detect the double feed of the document by a signal transmitted from the double feed detection unit 91. The second document detection unit 94 is a detection unit provided between the first transport roller pair 16 and the first reading unit 32 and the second reading unit 33, and the control unit 80 can detect the passage of the leading end or the trailing end of the document at the detection position by a signal transmitted from the second document detection unit 94.

Figure 10:
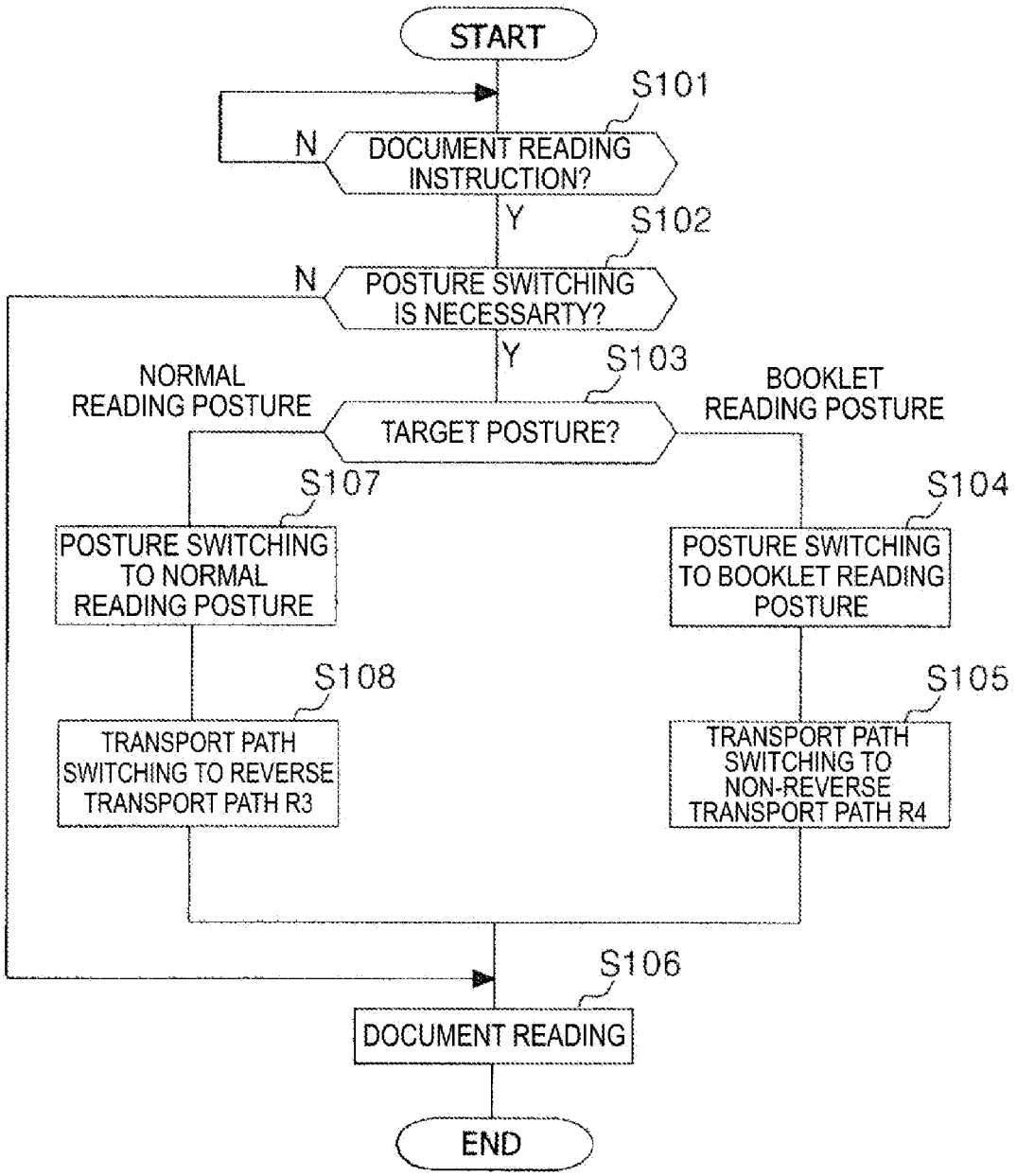
FIG. 10 is a flowchart illustrating control when the posture of the device main body is switched.

Next, an example of processing performed by the control unit 80 will be described with reference to FIG. 10. FIG. 10 is a flowchart illustrating processing performed by the control unit 80 when the posture of the device main body 2 is switched. In FIG. 10, when a document reading instruction is received (Y: Yes in Step S101), the control unit 80 determines whether or not it is necessary to switch the posture of the device main body 2 (Step S102). It is assumed here that the document reading instruction is received from the external device 500 (refer to FIG. 9) as an example. In the external device 500, the type of the document to be read can be set, and when the type of the document to be read is a card-like document or a booklet-like document, the control unit 80 sets the posture of the device main body 2 to the booklet reading posture, and when the type of the document to be read is a sheet-like document, the control unit 80 sets the posture of the device main body 2 to the normal reading posture.

In Step S102, an acquired document type and a current posture of the device main body 2 are compared with each other to determine whether or not it is necessary to switch the posture of the device main body 2. As a result, when the posture switching is not necessary (N:No in Step S102), the document is read without performing the posture switching control (Step S106). When the posture switching is necessary (Y:Yes in Step S102), the control unit 80 switches the posture of the device main body 2 to the booklet reading posture (Step S103) when a target posture is the booklet reading posture based on the target posture (Step S104), and also switches the document transport path to the non-reverse transport path R4 (Step S105). Steps S104 and S105 may be performed at the same time. Then, the document is read (Step S106).

In addition, when the target posture is the normal reading posture, the control unit 80 switches the posture of the device main body 2 to the normal reading posture (Step S107) based on the target posture (Step S103), and also switches the document transport path to the reverse transport path R3 (Step S108). Steps S107 and S108 may be performed at the same time. Then, the document is read (Step S106). When the device main body 2 is in the normal reading posture, detection information of the double feed detection unit 91 is validated, and when the device main body 2 is in the booklet reading posture, the detection information of the double feed detection unit 91 is invalidated.

As described above, the scanner 1 includes the main body support unit 6 placed at the placement surface G of the device and the device main body 2 supported by the main body support unit 6. The device main body 2 includes the reading transport path R2 which is a document transport path that transports a document and faces the first reading unit 32 and the second reading unit 33 that read the document, the reverse transport path R3 which is a document transport path located downstream of the reading transport path R2, reverses the read document upward and discharges the document, and the non-reverse transport path R4 which is a document transport path located downstream of the reading transport path R2 and discharges the read document without reversing the document. In addition, the flap 35 is provided for switching the document transport path coupled to the reading transport path R2 to any one of the reverse transport path R3 and the non-reverse transport path R4.

The device main body 2 is mounted to be rotatable with respect to the main body support unit 6, and can be switched between the normal reading posture (FIG. 6) and the booklet reading posture (FIG. 7) in which an angle formed by the reading transport path R2 and the placement surface G is smaller than that in the normal reading posture by rotation. The flap 35 couples the reading transport path R2 to the reverse transport path R3 when the device main body 2 is in the normal reading posture, and couples the reading transport path R2 to the non-reverse transport path R4 when the device main body 2 is in the booklet reading posture.

The scanner 1 can satisfactorily transport a document that is not easily bent using the non-reverse transport path R4. The document that is not easily bent includes a booklet and a card. The flap 35 couples the reading transport path R2 to the reverse transport path R3 when the device main body 2 is in the normal reading posture, and couples the reading transport path R2 to the non-reverse transport path R4 when the device main body 2 is in the booklet reading posture. Thus, it is possible to set a discharge direction of the document to a direction along the placement surface G rather than discharging the document using the non-reverse transport path R4 when the normal reading posture is taken. As a result, it is possible to discharge a document having a larger size than that in a configuration in which a document is discharged using the non-reverse transport path R4 when the normal reading posture is taken. Further, the angle formed by the reading transport path R2 and the placement surface G can be made larger than that in the booklet reading posture by setting the device main body 2 in the normal reading posture, and the footprint of the device main body 2 can be curbed.

Further, the posture of the device main body 2 may be switched by a button included in the operation unit 7. For example, one of the buttons constituting the operation unit 7 is assigned to a posture switching button, and when the posture switching button is pressed by the user while the current posture is the normal reading posture, the control unit 80 performs Steps S104 and S105. Further, when the user presses the posture switching button while the current posture is the booklet reading posture, the control unit 80 controls the posture switching motor 40 to perform Steps S107 and S108.

Figure 11:
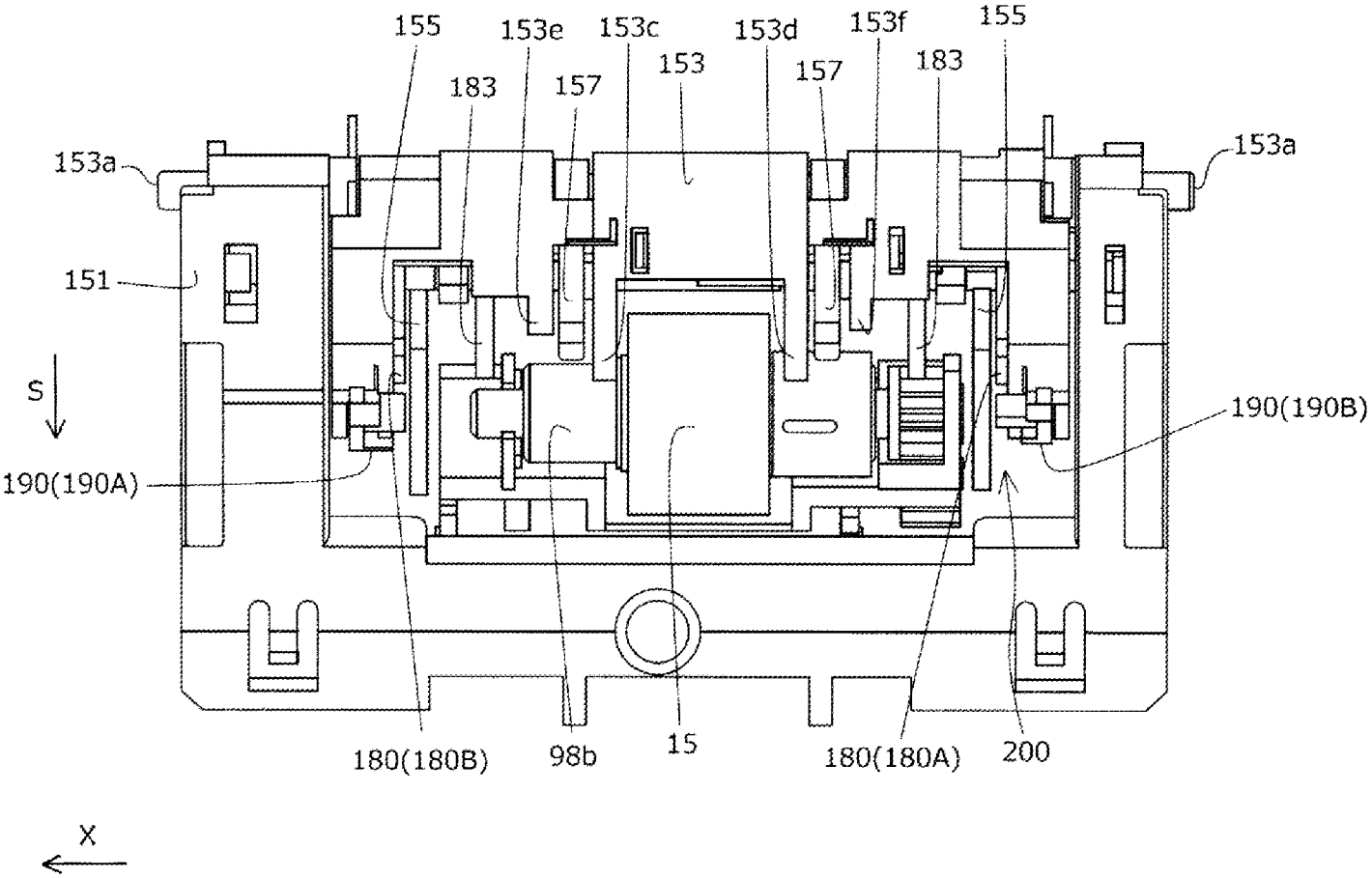
FIG. 11 is a diagram illustrating a surrounding configuration of a separation roller when seen from above.

Next, a peripheral configuration of the feeding roller 14 and the separation roller 15 will be described in detail with reference to FIG. 11 and subsequent drawings and other drawings as necessary. Here, an arrow S in FIG. 11 and subsequent drawings corresponds to the feeding direction. As illustrated in FIG. 11, a guide member 151, a set guide 153, a set flap 155, a pressing lever 157, and a skew correction mechanism 200 are provided around the separation roller 15. Details of the skew correction mechanism 200 will be described below.

As illustrated in FIG. 4, the guide member 151 is provided on the first frame 63. As illustrated in FIGS. 12 to 15, the set guide 153, the set flap 155, the pressing lever 157, and the skew correction mechanism 200 are provided in the guide member 151. The guide member 151 is a frame-like member, and the separation roller 15, the set guide 153, the set flap 155, the pressing lever 157, and the skew correction mechanism 200 are disposed inside the guide member 151. In FIG. 13, the set flap 155 is omitted. The guide member 151 is provided to be attachable to and detachable from the first frame 63 by a snap fit structure (not illustrated), and forms a part of the transport path of the document P in a state in which the guide member is mounted.

Figure 12:
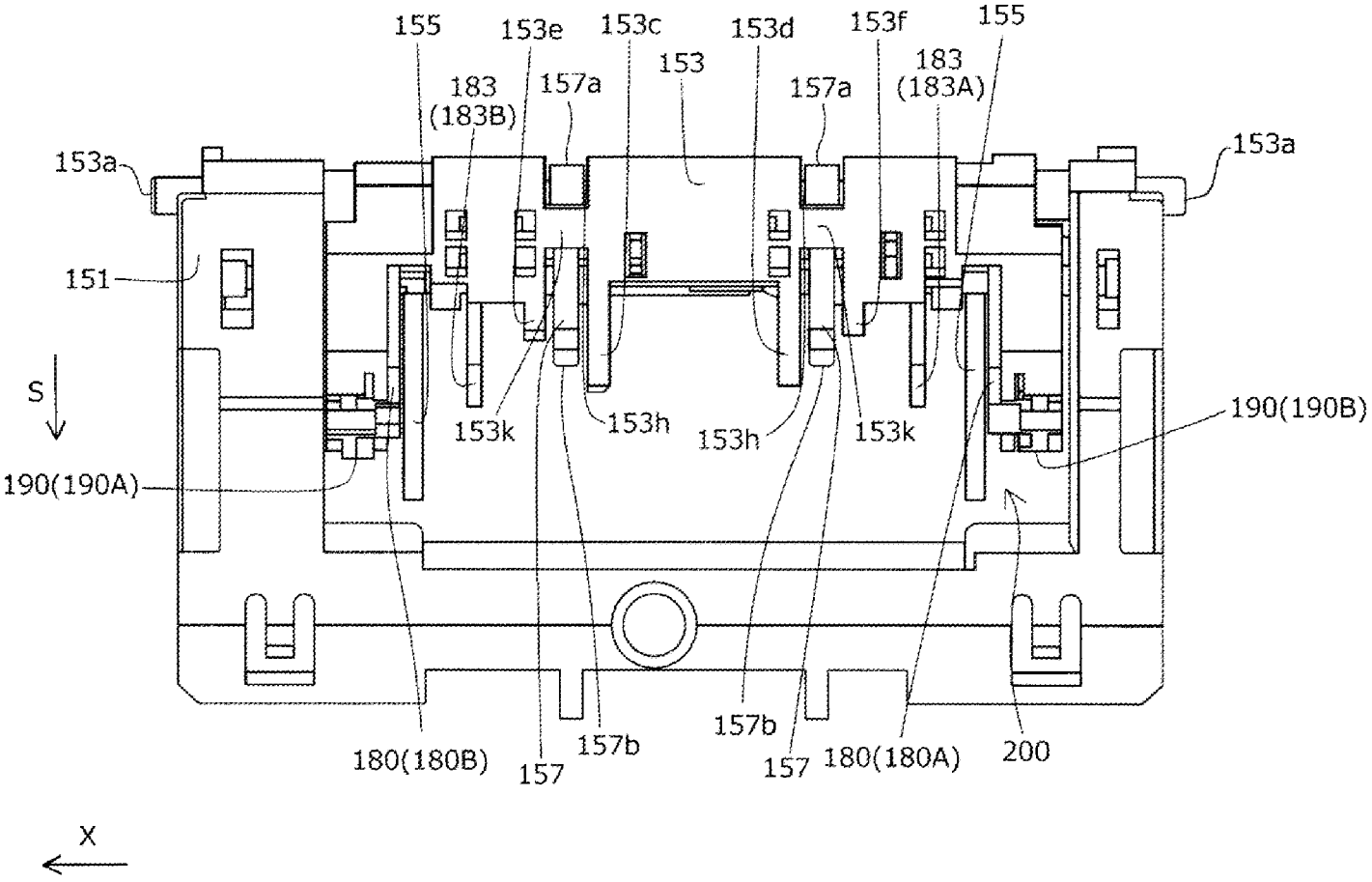
FIG. 12 is a diagram illustrating a peripheral configuration of a guide member and a set guide when seen from above.
Figure 13:
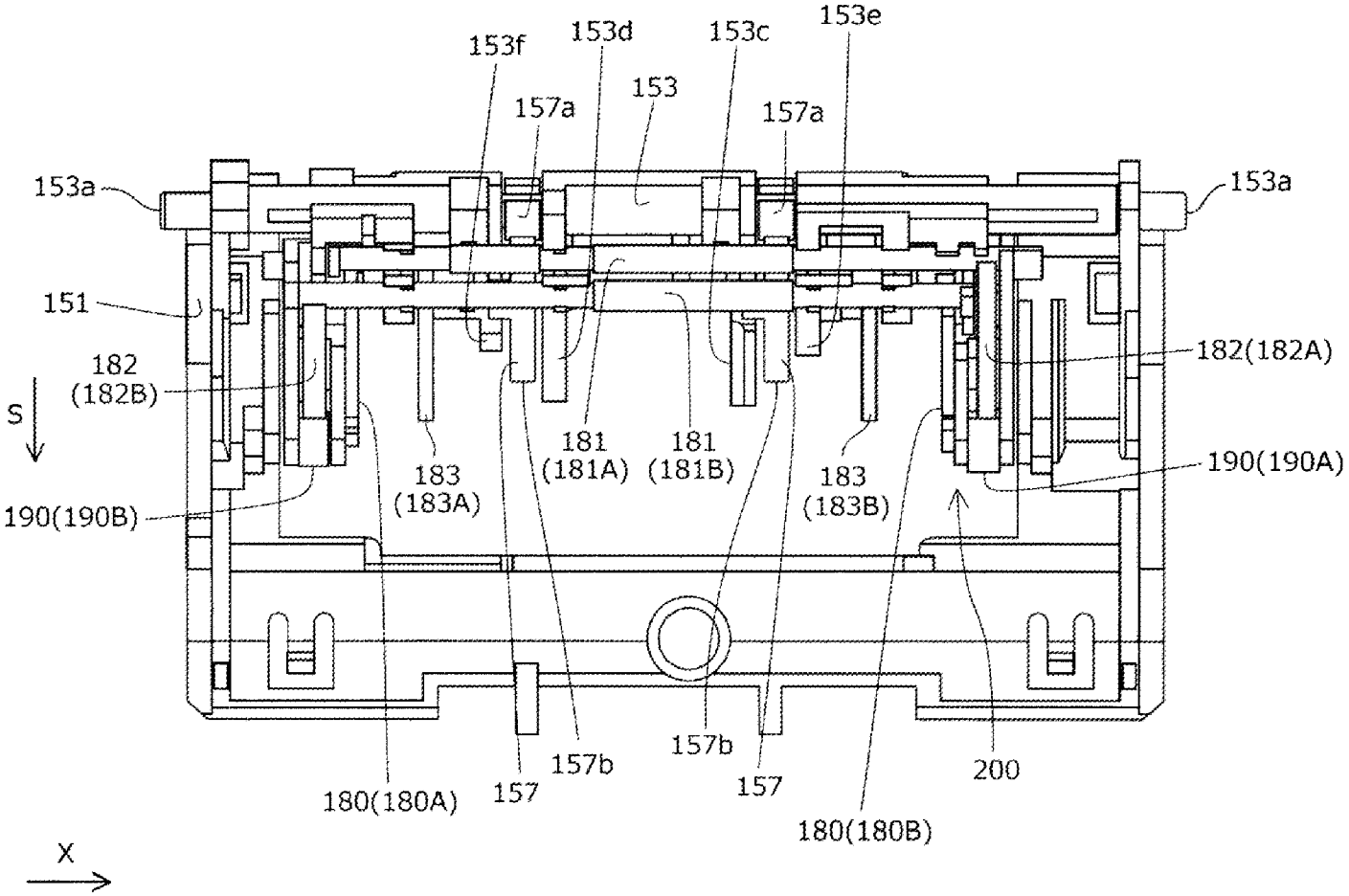
FIG. 13 is a diagram illustrating a peripheral configuration of a guide member and a set guide when seen from below.
Figure 14:
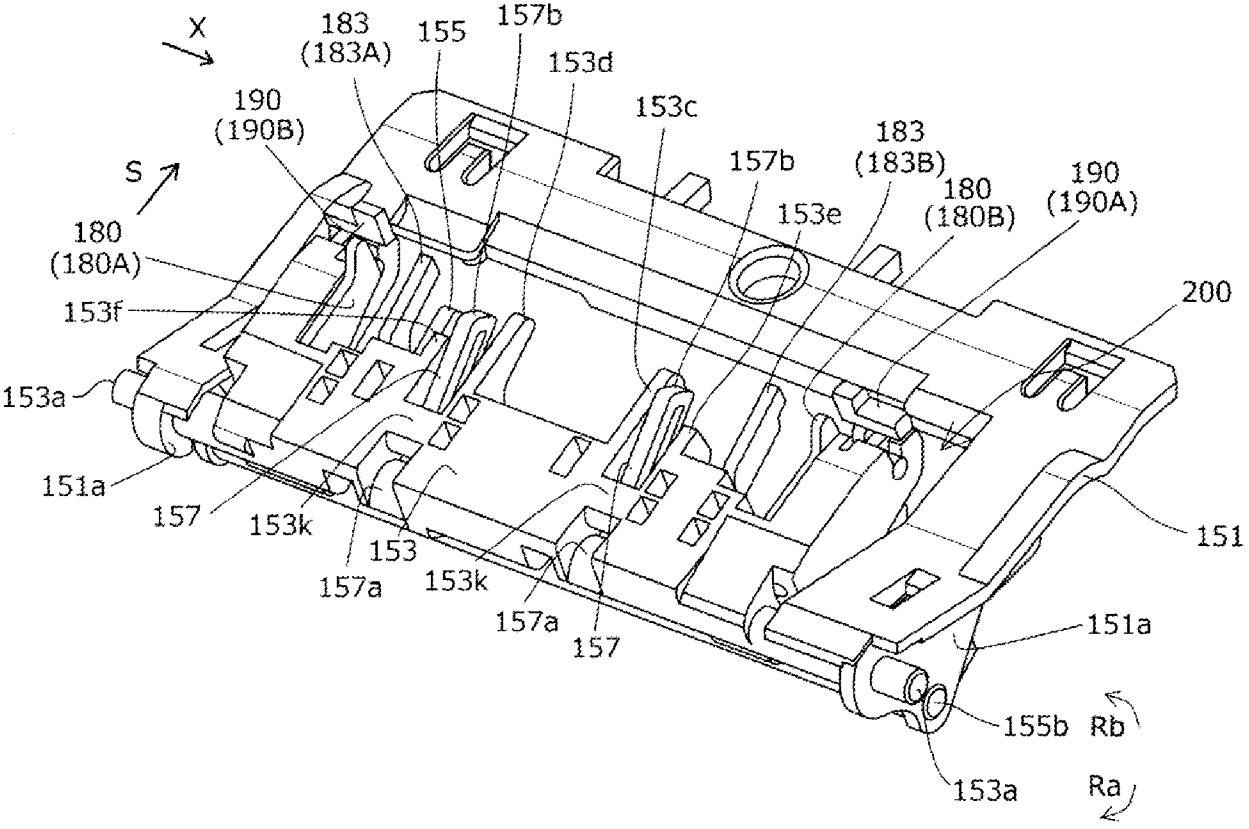
FIG. 14 is a perspective view illustrating the peripheral configuration of the guide member and the set guide.
Figure 15:
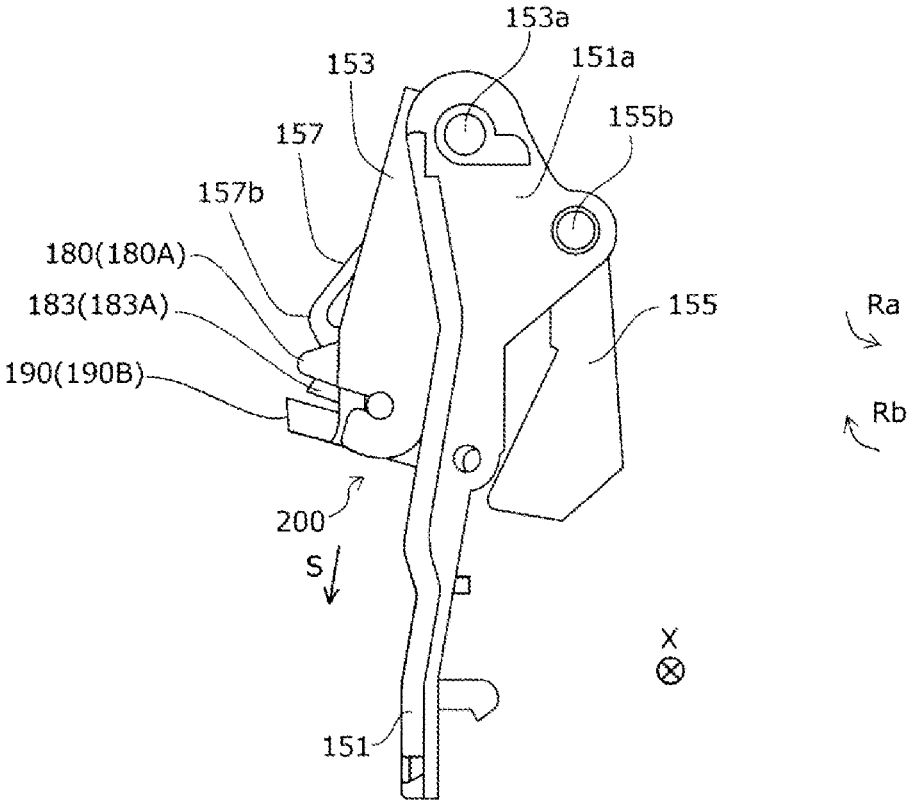
FIG. 15 is a side view of the peripheral configuration of the guide member and the set guide.

As illustrated in FIGS. 11 to 15, the set guide 153 has a rotating shaft 153*a* on both sides in the X-axis direction. As illustrated in FIG. 14, bearing units 151*a* are formed at both sides of the guide member 151 in the X-axis direction, and the rotating shaft 153*a* of the set guide 153 is rotatably supported by the bearing units 151*a*. The first frame 63 has a restriction structure (not illustrated) formed at both sides in the X-axis direction, and when the guide member 151 is mounted on the first frame 63, movement of the rotating shaft 153*a* of the set guide 153 in the feeding direction is restricted by the restriction structure.

Torsion coil springs (not illustrated) are provided on both sides of the set guide 153 in the X-axis direction and generate a pressing force between the guide member 151 and the set guide 153. The set guide 153 is pressed by the torsion coil spring in a rotation direction (a rotation direction Rb in FIG. 14) in which the downstream side in the feeding direction S is directed to the feeding roller 14 around the rotating shaft 153*a*.

As illustrated in FIG. 13, contact portions 153*j* are formed at both side surfaces of the set guide 153 in the X-axis direction, and the contact portions 153*j* come into contact with the lower side of the guide member 151 to restrict the rotation (in the rotation direction Rb) of the set guide 153. As illustrated in FIG. 5, in a state in which the second unit 4 is open respect to the first unit 3, the contact portions 153*j* come into contact with the lower side of the guide member 151. When the second unit 4 is closed with respect to the first unit 3 from this state, the feeding roller 14 comes into contact with long ribs 153*c* and 153*d* of the set guide 153, and thus the set guide 153 rotates by a predetermined amount in the rotation direction Ra in FIG. 14. In this state, the contact portions 153*j* are spaced apart from the lower side of the guide member 151.

A plurality of ribs extending in the document feeding direction are formed at the set guide 153 at predetermined intervals in the X-axis direction. The plurality of ribs include long ribs 153*c* and 153*d*, and short ribs 153*e* and 153*f* that are shorter than the long ribs in the feeding direction S. Here, the plurality of ribs are disposed to be line-symmetric with respect to a straight line passing through a center of the document P in the X-axis direction. Specifically, the long rib 153*c* and the long rib 153*d* are disposed to be symmetrical in the X-axis direction with respect to the straight line passing through the center of the document P, and the short rib 153*e* and the short rib 153*f* are disposed to be symmetrical in the X-axis direction with respect to the straight line passing through the center of the document P. However, the ribs may not necessarily be disposed to be symmetrical in the X-axis direction with respect to the straight line passing through the center of the document P.

As illustrated in FIG. 11, the long rib 153*c* and the long rib 153*d* are formed at positions capable of coming into contact with a cylindrical portion 98*b* forming the outer periphery of the torque limiter, and are configured such that the long ribs 153*c* and 153*d* can come into contact with the cylindrical portion 98*b* when the set guide 153 rotates in the rotation direction Ra.

As illustrated in FIG. 12, two shaft portions 153*h* are formed in the set guide 153, and the pressing lever 157 is pivotally supported by the shaft portions 153*h* as illustrated in FIG. 12 and the like. A reference numeral 157*a* is a shaft fitting portion of the pressing lever 157 that is fitted to the shaft portion 153*h*. In the embodiment, a rotation center position of the pressing lever 157 and a rotation center position of the set guide 153 coincide with each other. The rotation center position of the pressing lever 157 and the rotation center position of the set guide 153 may be different from each other. A torsion coil spring (not illustrated) is provided at a position adjacent to the pressing lever 157 to generate a pressing force between the pressing lever 157 and the set guide 153. The pressing lever 157 is pressed by the coil spring in a rotation direction (the rotation direction Ra) in which the downstream side of the feeding direction S is directed to the feeding roller 14 about the shaft portion 153*h*. That is, the pressing lever 157 is pressed by the coil spring in a direction in which a tip end portion 157*b* is directed to the feeding roller 14.

Figure 17:
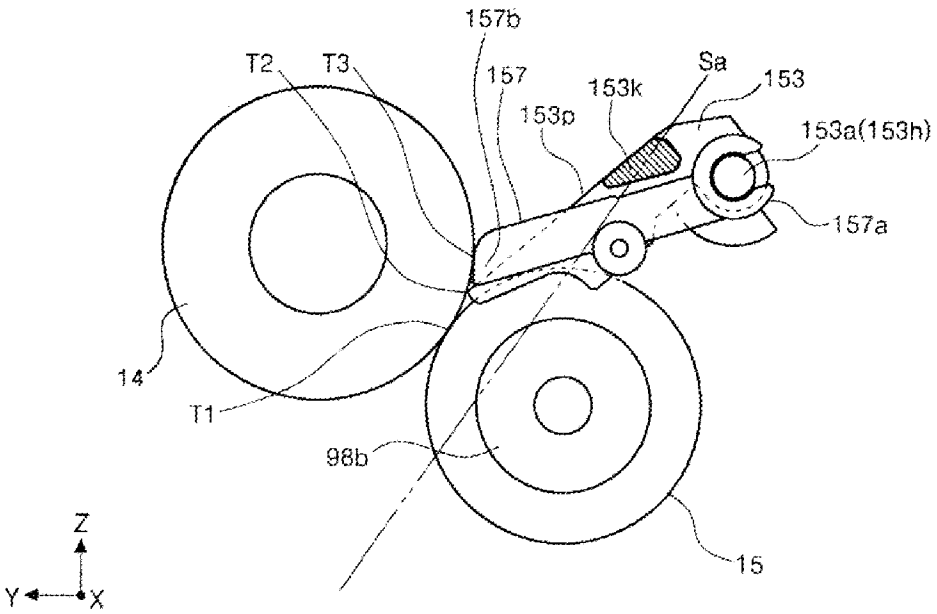
FIG. 17 is a side cross-sectional view illustrating a peripheral configuration of the separation roller.

As illustrated in FIGS. 11, 14, and 17, a contact portion 153*k* is formed at the set guide 153, and when the pressing lever 157 comes into contact with the contact portion 153*k*, the rotation (in the rotation direction Rb) of the pressing lever 157 is restricted. As illustrated in FIG. 5, in a state in which the second unit 4 is open with respect to the first unit 3, the pressing lever 157 comes into contact with the contact portion 153*k*. When the second unit 4 is closed with respect to the first unit 3 from this state, the feeding roller 14 comes into contact with the pressing lever 157, and thus the pressing lever 157 rotates by a predetermined amount in the rotation direction Ra. Since rotation limit of the pressing lever 157 in the state in which the second unit 4 is open is restricted by the contact portion 153*k*, the pressing lever 157 can appropriately rotate when the second unit 4 is closed. In this state, the pressing lever 157 is slightly separated from the contact portion 153*k*.

As illustrated in FIGS. 11 to 14, one of the two pressing levers 157 protrudes toward the transport path of the document P from between the long rib 153*c* and the short rib 153*e* located in the +X direction with respect to the long rib 153*c* in the set guide 153. Further, the other one of the two pressing levers 157 protrudes toward the transport path of the document P from between the long rib 153*f* and the short rib 153*d* located in the −X direction with respect to the long rib 153*d* in the set guide 153. Further, the two pressing levers 157 are disposed at positions symmetrical in the X-axis direction with respect to the straight line passing through the center of the document P. Furthermore, the two pressing levers 157 are rotatable independently of each other. In addition, the two pressing levers 157 are within a region of the feeding roller 14 in the X-axis direction and are located at both end portions of the feeding roller 14.

Figure 16:
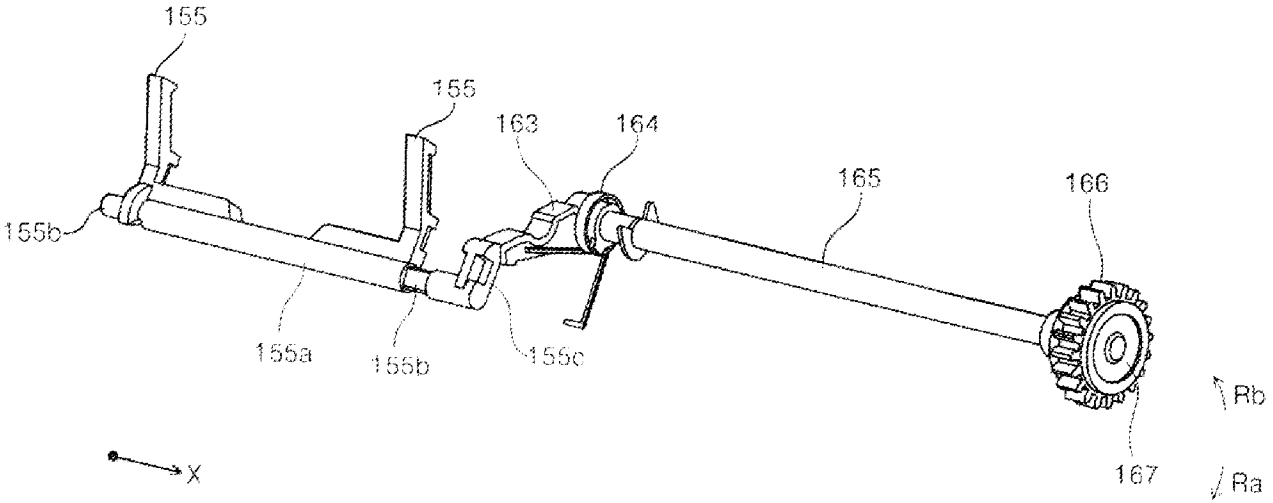
FIG. 16 is a perspective view illustrating a set flap and a part of a mechanism for driving the set flap.

As illustrated in FIGS. 11 and 12, two set flaps 155 are provided. As illustrated in FIG. 16, the two set flaps 155 are provided on a substantially shaft-like base portion 155*a* extending in the X-axis direction, and rotate integrally. Shaft portions 155*b* are formed at both sides of the base portion 155*a* in the X-axis direction, and each of the shaft portions 155*b* serves as a rotating shaft of the set flap 155. The shaft portions 155*b* are rotatably supported by the first frame 63.

In FIG. 16, a cam follower portion 155*c* is formed in the +X direction with respect to the shaft portion 155*b* in the +X direction. A set flap cam 163 is provided to be able to come into contact with the cam follower portion 155*c*. The set flap cam 163 is fixed to an end portion of a shaft 165 in the −X direction, and a gear 166 is provided at an end portion of the shaft 165 in the +X direction via a one way clutch 167. A driving force of the transport motor 50 is transmitted to the gear 166, and the gear 166 rotates in accordance with the rotation of the transport motor 50. The power of the transport motor 50 is transmitted to the shaft 165 via the gear 166 and the one way clutch 167.

The set flap cam 163 is provided with a spring 164. The spring 164 applies a pressing force to a first spring hook portion (not illustrated) and the set flap cam 163, and thus a pressing force in the rotation direction Rb acts on the set flap cam 163, that is, the shaft 165. FIG. 16 illustrates a feeding standby state in which the cam follower portion 155*c* is in contact with the set flap cam 163 and the set flap 155 blocks the document feeding path. In this state, the leading end of the document P to be set comes into contact with the set flap 155, and entry between the feeding roller 14 and the separation roller 15 is restricted. In this state, rotation of the set flap cam 163, that is, the shaft 165 in the rotation direction Rb is restricted by the action of the one way clutch 167. In addition, the gear 166 is stopped due to a load in a power transmission path between the gear 166 and the transport motor 50.

When the transport motor 50 rotates forward from this state and the gear 166 rotates in the rotation direction Rb, the shaft 165 rotates in the rotation direction Rb due to a pressing force of the spring 164, that is, the set flap cam 163 rotates in the rotation direction Rb. Thus, the set flap cam 163 is disengaged from the cam follower portion 155*c*, the set flap 155 rotates in the rotation direction Ra, and the set flap 155 is retracted from the document feeding path R1. When the set flap 155 is retracted from the document feeding path R1, the set document P can be directed to between the feeding roller 14 and the separation roller 15. Due to the forward rotation of the transport motor 50, each of the rollers provided in the transport path of the document P rotates in a direction in which the document P is transported downstream. At this time, the gear 166 in FIG. 16 continues to rotate in the rotation direction Rb, but the torque of the transport motor 50 is not transmitted to the shaft 165 by the action of the one way clutch 167.

When the transport motor 50 rotates reversely in a state in which the set flap 155 is retracted from the document feeding path R1, the gear 166 rotates in the rotation direction Ra in FIG. 16. When the gear 166 rotates in the rotation direction Ra, the torque in the rotation direction Ra is transmitted to the shaft 165 by the action of the one way clutch 167. Thus, the shaft 165, that is, the set flap cam 163 rotates in the rotation direction Ra against the pressing force of the spring 164 to push up the cam follower portion 155*c*, and the set flap 155 rotates in the rotation direction Rb to return to the state illustrated in FIG. 16.

The configuration around the separation roller 15 has been described above, and the set guide 153 will be further described below. As described above, FIG. 17 illustrates a state immediately before the feeding of the document P is started (a feeding start state). A reference numeral T1 denotes a contact position (a nipping position) between the feeding roller 14 and the separation roller 15, and is a contact position when it is assumed that both rollers are not elastically deformed. A reference numeral T2 denotes a contact position between the set guide 153 and the feeding roller 14, and a reference numeral T3 denotes a contact position between the tip end portion 157*b* of the pressing lever 157 and the feeding roller 14. As illustrated in the drawing, the contact position T2 is located upstream of the contact position T1 in the feeding direction, and the contact position T3 is located upstream of the contact position T2 in the feeding direction. A reference numeral Sa is a path forming surface formed by the upper surface of the first frame 63 .

Figure 18A:
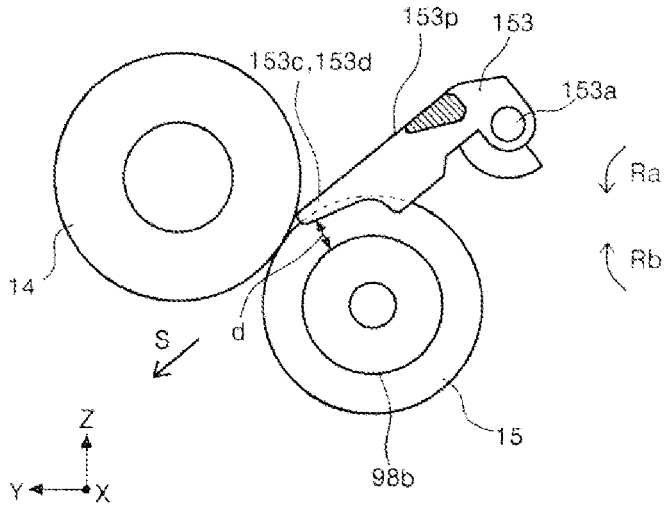
FIG. 18A is a diagram illustrating a feeding standby state and FIG. 18B is a diagram illustrating a state in which a separation roller is displaced.
Figure 18B:
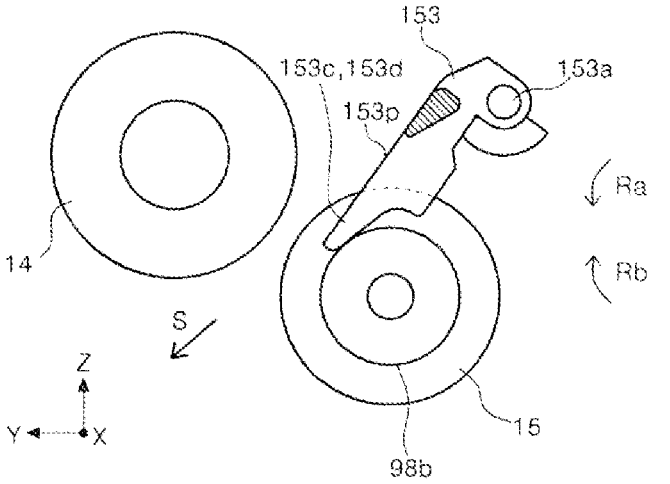

In FIGS. 18 and 19, the set flap 155 and the pressing lever 157 are omitted in order to avoid complication of the drawings. FIG. 18A is a view corresponding to FIG. 17, and in the feeding start state, unless a thick medium such as a booklet-like document is used, a gap d is formed between the long ribs 153*c* and 153*d* and the cylindrical portion 98*b* of the set guide 153. In addition, since the set guide 153 is advanced with respect to the feeding roller 14, the document feeding path R1 toward the contact position T1 is narrowed. The set guide 153 eliminates the gap d when a thickness of the document to be set exceeds a predetermined thickness, and as illustrated in FIG. 18B, the cylindrical portion 98*b*, that is, the separation roller 15 is pushed down by the long rib 153*d*. Thus, the separation roller 15 is separated from the feeding roller 14. The relationship between the set guide 153 and the separation roller 15 has been described above.

Figure 19A:
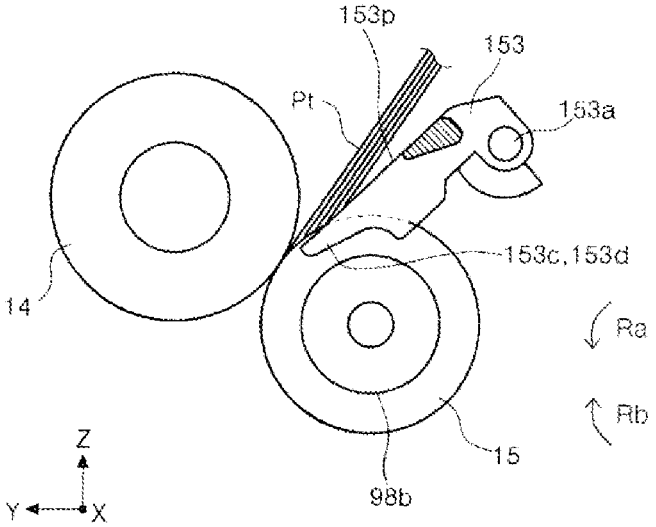
FIG. 19A is a diagram illustrating a state in which a plurality of sheet-like documents are fed.

FIG. 19A illustrates the feeding start state when a plurality of sheet-like documents Pt are placed, and in this state, the long ribs 153*c* and 153*d* are separated from the cylindrical portion 98*b* and the separation roller 15 is not pressed down. As an example, when a thickness of a document bundle of the sheet-like documents Pt is less than 2 mm, the long ribs 153*c* and 153*d* do not come into contact with the cylindrical portion 98*b*. In this state, an upper surface 153*p* of the set guide 153 applies a preliminary separating action to the leading end of the document Pt. The upper surface 153*p* of the set guide 153 is formed by the upper surface of the entire set guide 153 including the long ribs 153*c* and 153*d* and the short ribs 153*e* and 153*f* described above.

Figure 19B:
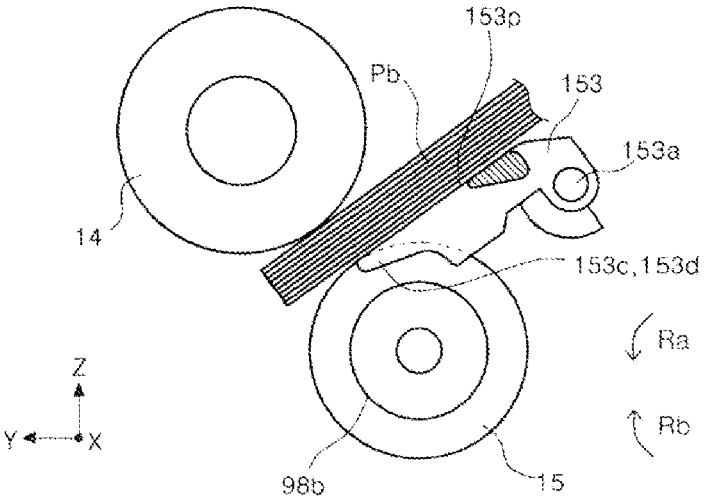
FIG. 19B is a diagram illustrating a state in which a booklet-like document is fed.

FIG. 19B illustrates a state in which a booklet-like document Pb is fed after being placed. In the process of reaching this state, the set guide 153 is pushed down by the booklet-like document Pb, the long ribs 153*c* and 153*d* come into contact with the cylindrical portion 98*b*, the separation roller 15 is pushed down, and a gap is formed between the feeding roller 14 and the separation roller 15. For example, when a thickness of the booklet-like document Pb is 2 mm or more, the long ribs 153*c* and 153*d* come into contact with the cylindrical portion 98*b*. When the booklet-like document Pb is transported by the feeding roller 14, the separation roller 15 is pushed down by the booklet-like document Pb. When the booklet-like document Pb is nipped and transported by the feeding roller 14 and the separation roller 15, it is preferable that the long ribs 153*c* and 153*d* are separated from the cylindrical portion 98*b* as illustrated in FIG. 19B Since the separation roller 15 is not pushed down by the set guide 153, it is possible to stably nip the booklet-like document Pb between the separation roller 15 and the feeding roller 14.

As described above, the scanner 1 or the document feeding device 150 includes the set guide 153 upstream of the contact position T1 between the feeding roller 14 and the separation roller 15 in the document feeding direction. The set guide 153 is capable of advancing and retracting with respect to the feeding roller 14 in accordance with the thicknesses of the document, and narrows the document feeding path R1 toward the contact position T1 by advancing with respect to the feeding roller 14. The set guide 153 is capable of engaging with the separation roller 15 and displaces the separation roller 15 in a direction away from the feeding roller 14 when it is pushed down in a direction away from the feeding roller 14 by the document P having a thickness exceeding a predetermined thickness. In this way, when the document P having a thickness exceeding a predetermined thickness is fed, the separation roller 15 is separated from the feeding roller 14 in advance before the document P enters between the separation roller 15 and the feeding roller 14, and thus it is possible to curb a situation in which the document P having the thickness exceeding the predetermined thickness collides with the separation roller 15 and cannot be fed.

Further, as illustrated in FIG. 19A, when a plurality of sheet-like documents Pt are supported by the document support unit 11, the upper surface of the set guide 153 applies a separating action to the leading ends of the documents Pt. Thus, the separation by the set guide 153 is performed prior to the separation of the documents Pt by the feeding roller 14 and the separation roller 15, and thus it is possible to more reliably separate the documents Pt.

In addition, the set guide 153 includes a plurality of ribs (the long rib 153*c*, the long rib 153*d*, the short rib 153*e*, and the short rib 153*f*) extending in the feeding direction S of the document P, and the plurality of ribs are disposed to be symmetrical in the X-axis direction with respect to a straight line passing through the center of the document P in the width direction (the X-axis direction) which is a direction intersecting the feeding direction S. Thus, a frictional force applied to the document P by the set guide 153 becomes equal on the left and right sides in the width direction, and thus the skew of the document P can be curbed.

In addition, the straight line passing through the center of the document P in the width direction passes through the center position of the feeding roller 14 and the center position of the separation roller 15, and the long ribs 153*c* and 153*d* which are two ribs close to the straight line among the plurality of ribs are located with the separation roller 15 interposed therebetween in the width direction and are located in the region of the feeding roller 14. Thus, the document feeding path toward the contact position T1 can be appropriately narrowed, and the number of documents toward the contact position T1 can be appropriately restricted. As a result, the separating action by the separation roller 15 can be appropriately obtained.

In addition, in the embodiment, the separation unit disposed to face the feeding roller 14 is configured of the rotatable separation roller 15, and the set guide 153 is configured to engage with the separation roller 15 by coming into contact with the cylindrical portion 98*b* centered on a rotation center of the separation roller 15. As described with reference to FIG. 18, when the thickness of the document is thinner than or equal to a predetermined thickness, there is the gap d between the set guide 153 and the cylindrical portion 98*b*, and when the thickness of the document exceeds the predetermined thickness, the set guide 153 comes into contact with the cylindrical portion 98*b* and displaces the separation roller 15 in a direction away from the feeding roller 14. Thus, it is possible to reliably separate the separation roller 15 from the feeding roller 14. Although the set guide 153 pushes down the cylindrical portion 98*b* constituting the outer periphery of the torque limiter in the embodiment, the set guide 153 may push down the rotating shaft of the separation roller 15. In any case, the set guide 153 indirectly pushes down the separation roller 15 via another member, but the set guide 153 may directly push down the separation roller 15.

Figure 20A:
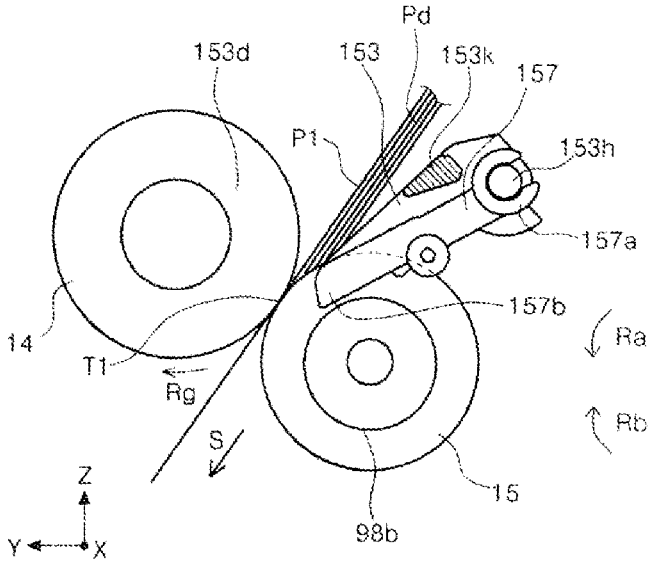
FIG. 20A is a diagram illustrating a state in which a document is being fed.
Figure 20B:
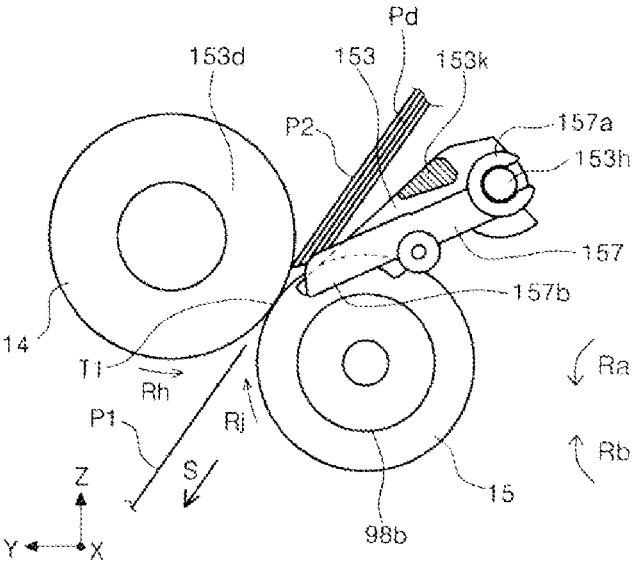
FIG. 20B is a diagram illustrating a state in which a trailing end of a document to be fed is out of a contact position between a feeding roller and a separation roller.

Next, the movement of the pressing lever 157 will be described with reference to FIG. 20. In FIG. 20, the set flap 155 is not illustrated. In FIG. 20, a reference numeral P1 denotes a document to be fed, a reference numeral Pd denotes a document bundle below the document P1, and a reference numeral P2 denotes a document which is the uppermost medium of the document bundle Pd and is to be fed following the document P1. FIG. 20A illustrates a state in which the document P1 is being fed, and in this state, the feeding roller 14 applies a feeding force to the document P1 toward the downstream side in the feeding direction S by the forward rotation (a direction of an arrow Rg) of the feeding roller 14, and thus the document bundle Pd also tends to move toward the downstream side in the feeding direction S. Therefore, the document bundle Pd presses down the pressing lever 157 against the spring force of the coil spring (not illustrated), and the pressing lever 157 does not protrude upward from the set guide 153.

In this state, the pressing lever 157 is not in contact with the cylindrical portion 98*b*, and the pressing lever 157 does not press down the separation roller 15. Thus, it is possible to prevent a timing at which the separation roller 15 is separated from the feeding roller 14 from being inappropriate.

Next, when a trailing end of the document P1 passes through the contact position T1 between the feeding roller 14 and the separation roller 15 from the state illustrated in FIG. 20A, spring back of the torque limiter that applies a rotational load to the separation roller 15 occurs, and the separation roller 15 rotates reversely (a direction of an arrow Rj). In the embodiment, since the one way clutch is not provided in the feeding roller 14, the feeding roller 14 is also reversely rotated (a direction of an arrow Rh) in accordance with the reverse rotation of the separation roller 15.

Here, when the feeding roller 14 is freely rotatable reversely, the document bundle Pd including the document P2 is strongly returned to the upstream side in the feeding direction S by the reverse rotation of the feeding roller 14, and thus there is a concern that remarkable skew feeding or non-feeding occurs. However, the pressing lever 157 is provided, and after the trailing end of the fed document P1 passes through the contact position T1, the document bundle Pd is pressed toward the feeding roller 14 by the tip end portion 157*b* of the pressing lever 157. Thus, the phenomenon in which the document bundle Pd is strongly returned to the upstream side in the feeding direction S is curbed, and it is possible to curb paper feeding failure such as skew or non-feeding. In particular, in the embodiment, since the document is fed from the uppermost document among the documents supported by the document support unit 11, the uppermost document P2 to be returned to the upstream side in the feeding direction S by the reverse rotation of the feeding roller 14 is likely to be skewed and is likely to be returned to the upstream side in the feeding direction S. However, due to the action of the pressing lever 157 described above, it is possible to curb the phenomenon in which the document P2 is strongly returned to the upstream side in the feeding direction S, and it is possible to curb a feeding failure such as skew or non-feeding.

In addition, in the embodiment, the pressing lever 157 rotates about the shaft portion 153*h* serving as the rotating shaft so that the tip end portion 157*b* advances and retracts with respect to the feeding roller 14, and the shaft portion 153*h* is located on the upstream side in the feeding direction S with respect to the tip end portion 157*b*. Here, when the document P is about to be returned to the upstream side in the feeding direction S by the reverse rotation of the feeding roller 14, if the pressing lever 157 which comes into contact with the document P is easily rotated in the rotation direction Rb, the document P is easily returned to the upstream side in the feeding direction S. However, since the shaft portion 153*h* is located on the upstream side in the feeding direction S with respect to the tip end portion 157*b*, the pressing lever 157 which comes into contact with the document P is configured to be difficult to rotate, and it is possible to effectively curb the phenomenon in which the document P is returned to the upstream side by the reverse rotation of the feeding roller 14.

In addition, the set guide 153 is provided with a contact portion 153*k* that restricts a rotation limit of the pressing lever 157 in a direction in which the tip end portion 157*b* of the pressing lever 157 advances to the feeding roller 14. Thus, the rotation of the pressing lever 157 in the rotation direction Rb is more reliably curbed, and it is possible to effectively curb the phenomenon in which the document P is returned to the upstream side by the reverse rotation of the feeding roller 14.

In addition, in the embodiment, the pressing lever 157 is provided within a region of the feeding roller 14 in the X-axis direction, that is, the width direction which is a direction intersecting the feeding direction S. Thus, the document can be reliably pressed against the feeding roller 14 by the pressing lever 157, and the phenomenon in which the medium is returned to the upstream side by the reverse rotation of the feeding roller 14 can be more reliably curbed.

In the embodiment, the pressing lever 157 is provided at both end portions in the width direction with respect to one feeding roller 14. Thus, it is possible to curb skew when the document P is about to be returned to the upstream side by the reverse rotation of the feeding roller 14. When a plurality of feeding rollers 14 are provided in the X-axis direction, it is preferable that the pressing levers 157 are provided at both end portions with respect to the entirety of the plurality of feeding rollers 14. Thus, it is possible to curb skew when the document P is about to be returned to the upstream side. Further, instead of the configuration in which the plurality of pressing levers 157 are provided, for example, one pressing lever may be provided at a center position in the X-axis direction.

In addition, in the embodiment, the plurality of pressing levers 157 can independently advance and retract with respect to the feeding roller 14. Here, when the plurality of pressing levers 157 are configured to integrally advance and retract, a difference in a pressing state of the document P by each of the plurality of pressing levers 157 occurs, and there is a concern that skew of the document P occurs. For example, when one of the pressing levers 157 is in contact with the document and the other pressing lever 157 is not in contact with the document P, skew of the document P occurs. However, in the embodiment, since the plurality of pressing levers 157 can independently advance and retract with respect to the feeding roller 14, each of the plurality of pressing levers 157 appropriately presses the document P, and the above-described skew can be curbed.

In the embodiment, as described with reference to FIG. 17, since the contact position T3 at which the pressing lever 157 comes into contact with the feeding roller 14 is upstream of the contact position T2 at which the set guide 153 comes into contact with the feeding roller 14, when the document P is about to be returned to the upstream side by the reverse rotation of the feeding roller 14, the document P can be pressed for a longer period, and the phenomenon in which the document P is returned to the upstream side by the reverse rotation of the feeding roller 14 can be more reliably curbed.

Further, the pressing force with which the coil spring (not illustrated) presses the pressing lever 157 is smaller than the pressing force with which the coil spring (not illustrated) presses the set guide 153. For this reason, when the document P is fed, the pressing lever 157 is easily retracted from the document feeding path R1, and it is possible to curb the pressing lever 157 hindering feeding of the document P.

Figure 21:
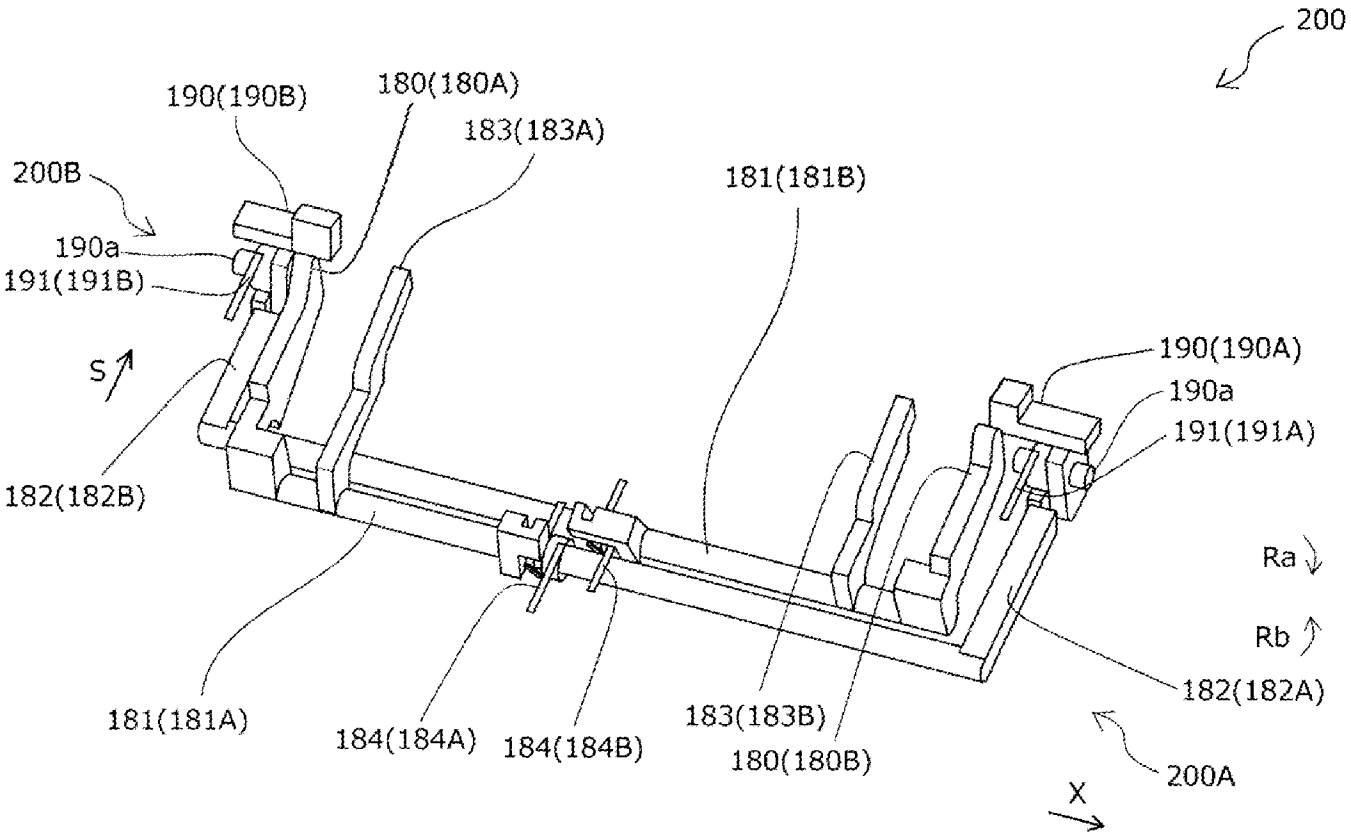
FIG. 21 is a diagram for describing a skew correction mechanism, and is a perspective view illustrating a state before a medium collides with a first lever member and a second lever member.
Figure 22:
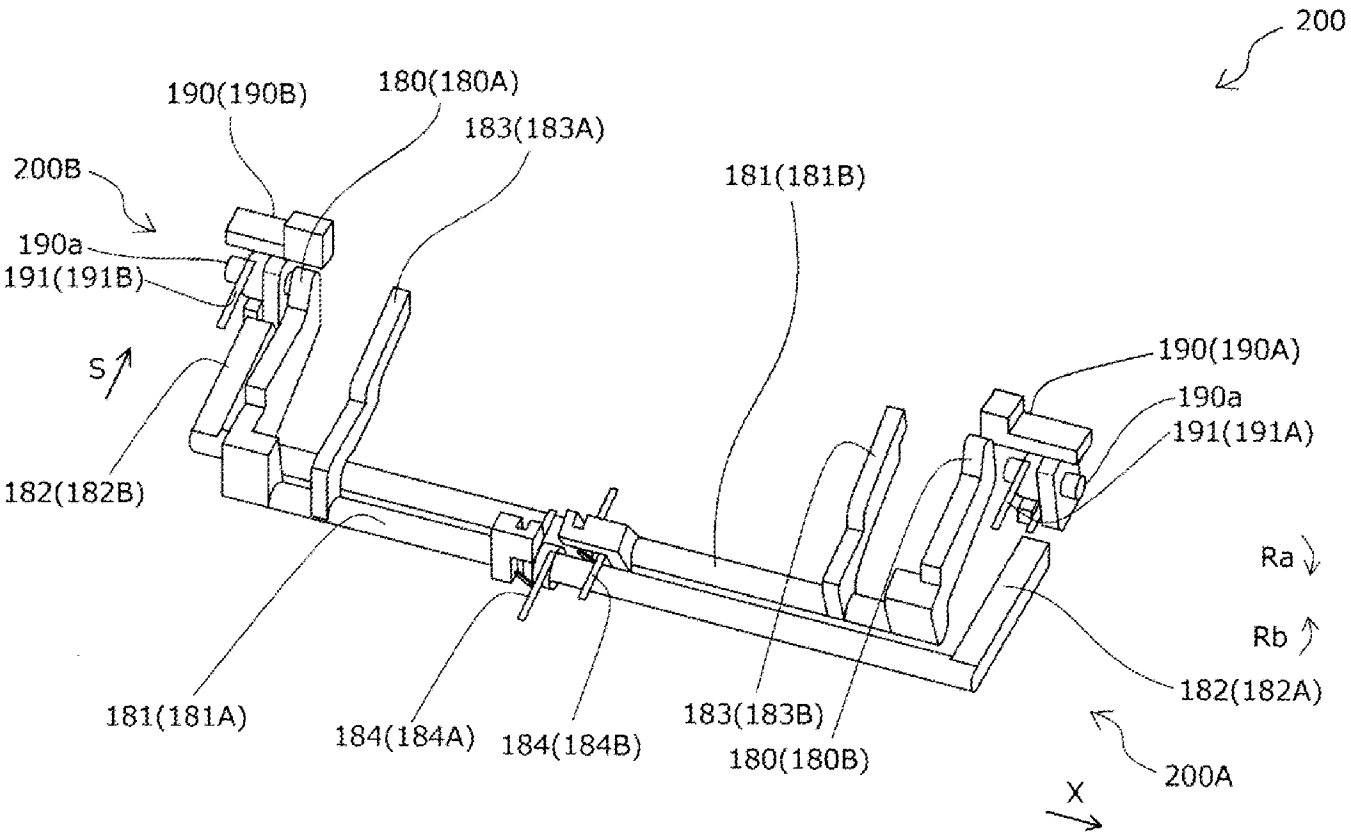
FIG. 22 is a diagram for describing the skew correction mechanism, and is a perspective view illustrating a state in which the medium has collided with the first lever member from the state illustrated in FIG. 21 and a first contact portion is separated from a first load member.
Figure 23:
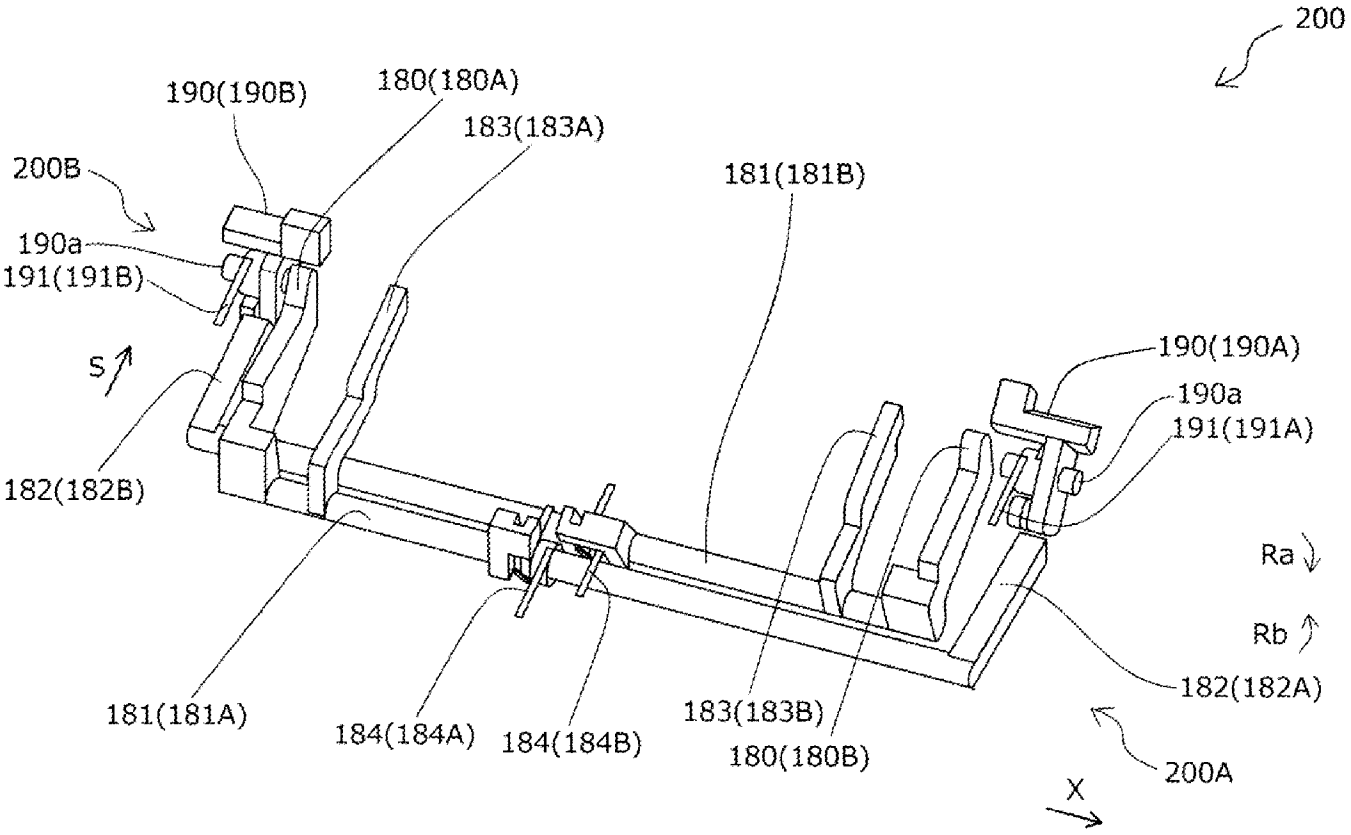
FIG. 23 is a diagram for describing the skew correction mechanism, and is a perspective view illustrating a state in which the first load member is displaced from a blocking position illustrated in FIG. 22 to an opening position by the first contact portion being separated from the first load member.

As described above, the scanner 1 according to the embodiment includes the document support unit 11 that is a placement portion on which the document P that is a medium is placed, the document feeding path R1, the reading transport path R2, the reverse transport path R3, and the non-reverse transport path R4 that are transport paths along which the document P is transported, and the feeding roller 14 that is one of the transport rollers for transporting the document P along the transport path, and further includes the skew correction mechanism 200 that corrects skew of the document P to be transported. Next, the skew correction mechanism 200 will be described in detail. FIGS. 21 to 23 illustrate the skew correction mechanism 200 according to the embodiment. The skew correction mechanism 200 illustrated in FIGS. 21 to 23 is mounted on the set guide 153 as illustrated in FIG. 13.

The skew correction mechanism 200 according to the embodiment includes a lever member 180 which is provided upstream of the contact position T1 which is a nipping position between the feeding roller 14 and the separation roller 15 in the feeding direction S and is capable of detecting the document P being transported, and a load member 190 which is capable of preventing the transport of the document P at a partial position in the width direction.

As illustrated in FIGS. 21 to 23, the skew correction mechanism 200 according to the embodiment includes a first skew correction unit 200A including a first lever member 180A of the lever member 180 and a first load member 190A of the load member 190, and a second skew correction unit 200B including a second lever member 180B of the lever member 180 and a second load member 190B of the load member 190.

Figure 24A:
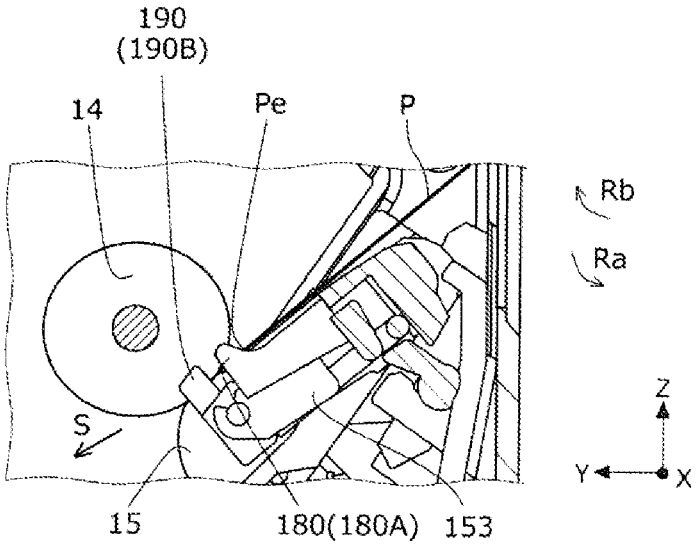
FIG. 24A is a side view corresponding to FIG. 21 and illustrating a state in which the first lever member is located at an advanced position before the medium collides.
Figure 24B:
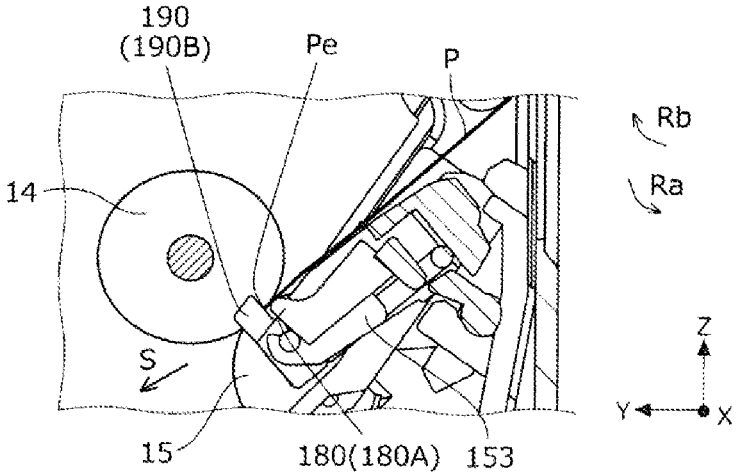
FIG. 24B is a side view corresponding to FIG. 22 and illustrating a state in which the first lever member is located at a retracted position by the medium colliding with the first lever member.
Figure 26A:
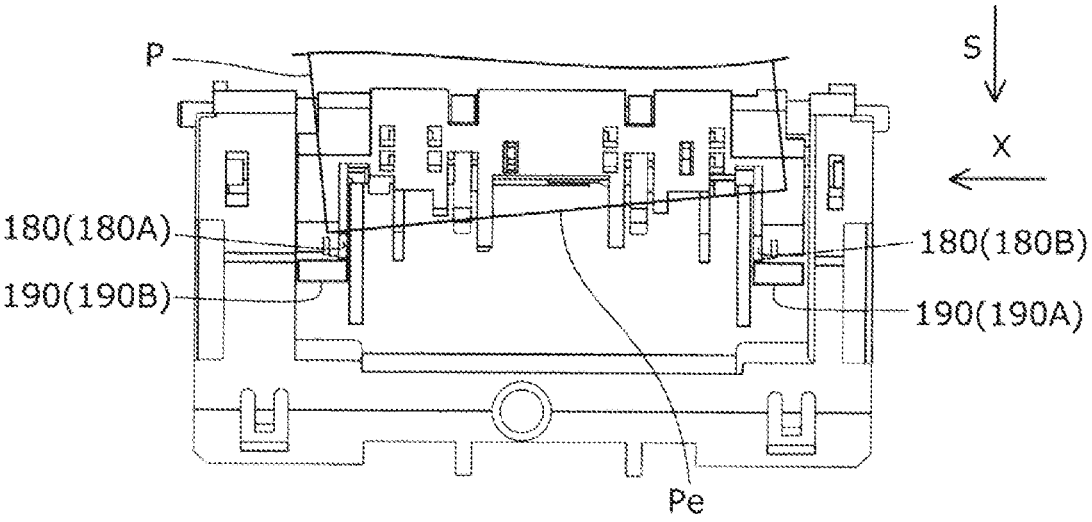
FIG. 26A is a side view illustrating a moment at which the medium collides with the first lever member.
Figure 26B:
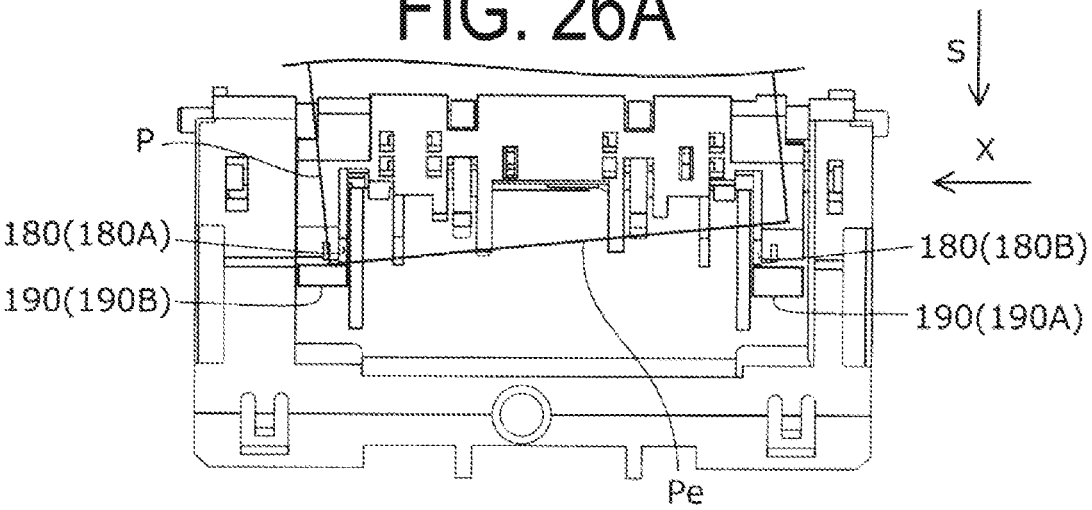
FIG. 26B is a side view illustrating a state in which the first load member is displaced from the blocking position to the opening position by the medium colliding with the first lever member.

Here, the first lever member 180A and the second lever member 180B can be displaced between an advanced position at which the first lever member 180A and the second lever member 180B can come into contact with the document P and are advanced to the transport path of the document P and a retracted position at which the first lever member 180A and the second lever member 180B are retracted from the transport path of the document P when the document P comes into contact with and passes through the first lever member 180A and the second lever member 180B. Here, FIG. 21 illustrates a state in which both the first lever member 180A and the second lever member 180B are at the advanced position. FIG. 24A corresponding to FIG. 21 illustrates a state in which the first lever member 180A is at the advanced position. As illustrated in FIGS. 14 and 24A, the first lever member 180A and the second lever member 180B at the advanced position are positioned by being in contact with the set guide 153. On the other hand, FIG. 22 illustrates a state in which the leading end Pe (refer to FIG. 24) of the skewed and document P being transported comes into contact with only the first lever member 180A of the first lever member 180A and the second lever member 180A and the first lever member 180B is displaced from the advanced position to the retracted position. FIG. 26A illustrates a moment when the leading end Pe of the document P comes into contact with the first lever member 180A. Further, following the state of FIG. 26A, the first lever member 180A is displaced from the advanced position to the retracted position according to the transport of the document P, and the transport of the document P is continued as illustrated in FIG. 26B. In FIG. 26B, the first lever member 180A is located at the retracted position. FIG. 24B corresponding to FIG. 22 illustrates a state in which the first lever member 180A is at the retracted position.

Figure 25A:
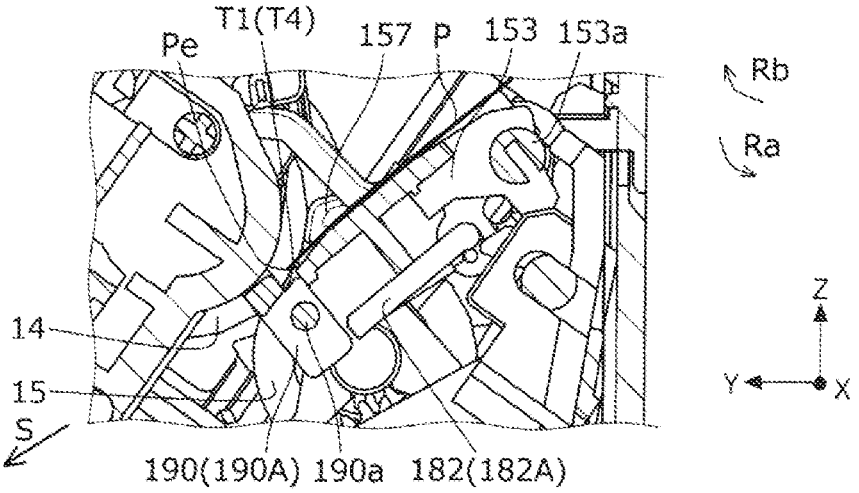
FIG. 25A is a side view corresponding to FIG. 21 and illustrating a state in which the first load member is located at the blocking position before the medium collides.
Figure 25B:
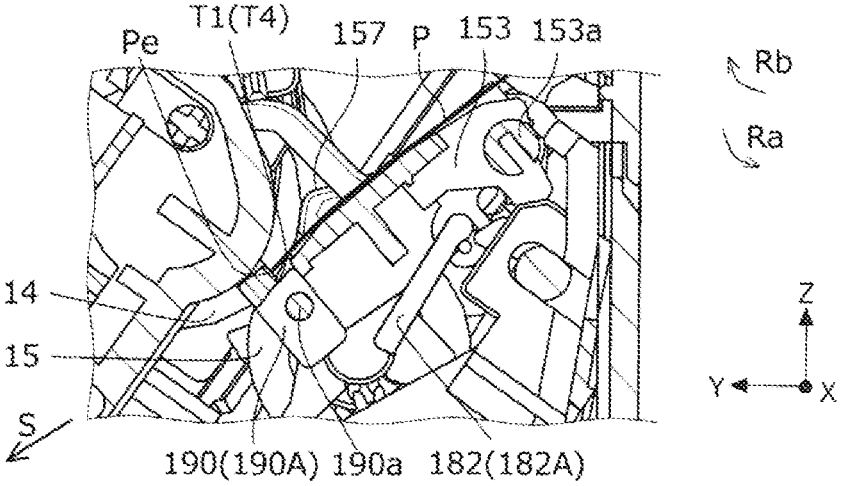
FIG. 25B is a side view corresponding to FIG. 22 and illustrating a state in which the first contact portion is separated from the first load member by the medium colliding with the first lever member.
Figure 25C:
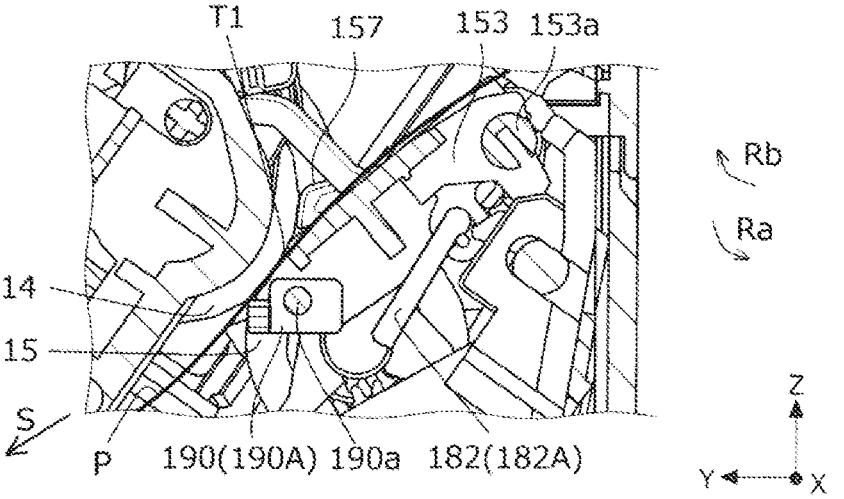
FIG. 25C is a side view corresponding to FIG. 23 and illustrating a state in which the first load member is displaced from the blocking position to the opening position by the first contact portion being separated from the first load member.

The first load member 190A and the second load member 190B are provided downstream of the first lever member 180A and the second lever member 180B in the feeding direction S, and can be displaced between a blocking position at which a part of the transport path in the width direction intersecting the feeding direction S is blocked and an opening position at which the transport path is opened without blocked. Here, FIGS. 21 and 22 illustrate a state in which both the first load member 190A and the second load member 190B are at the blocking position. FIG. 25A corresponding to FIG. 21 and FIG. 25B corresponding to FIG. 22 illustrates a state in which the first load member 190A is at the blocking position. As illustrated in FIGS. 14 and 25A, the first load member 190A and the second load member 190B at the blocking position are positioned by being in contact with the set guide 153. On the other hand, FIG. 23 illustrates a state in which the leading end Pe of the skewed and document P being transported comes into contact with the first lever member 180A and the first lever member 180A is displaced from the advanced position to the retracted position and a state in which the first load member 190A is displaced from the blocking position to the opening position. FIG. 25C corresponding to FIG. 23 illustrates a state in which the first load member 190A is at the opening position.

The operation of the lever member 180 and the load member 190 described above with reference to FIGS. 21 to 25 is a case in which the document P is transported in a skewing direction in which the leading end Pe of the skewed and transported document P comes into contact with only the first lever member 180A of the first lever member 180A and the second lever member 180B, that is, a case of skew transport in which the leading end Pe on the first lever member 180A side precedes the leading end Pe on the second lever member 180B side in the width direction of the document. On the other hand, in a case of the skew transport in which the leading end Pe on the second lever member 180B side precedes the leading end Pe on the first lever member 180A side in the width direction of the document, the operation of the lever member 180 and the load member 190 can be described by setting the first lever member 180A and the second lever member 180B reversely and setting the first load member 190A and the second load member 190B reversely in the above description.

Here, the feeding roller 14 is provided between the first load member 190A and the second load member 190B in the width direction, and as illustrated in FIGS. 24 and 25, when the first load member 190A and the second load member 190B are located at the blocking position, the first load member 190A and the second load member 190B overlap a part of the feeding roller 14 when seen in the width direction. As described above, the first load member 190A is configured to be located at the blocking position when the first lever member 180A is located at the advanced position, and to be displaceable from the blocking position to the opening position when the first lever member 180A is displaced from the advanced position and located at the retracted position. Further, the second load member 190B is configured to be located at the blocking position when the second lever member 180B is located at the advanced position, and to be displaceable from the blocking position to the opening position when the second lever member 180B is displaced from the advanced position and located at the retracted position.

As described above, it is preferable that the first load member 190A and the second load member 190B are configured to overlap at least a part of the feeding roller 14 when seen in the width direction when the first load member 190A and the second load member 190B are located at the blocking position. In other words, it is preferable to provide the skew correction mechanism 200 at a position that is not separated from the feeding roller 14 in the feeding direction S. With such a configuration, even when a medium having low stiffness such as a thin medium is used, skew correction can be performed at a position at which the stiffness of the medium does not become low (a position close to the feeding roller 14), and thus skew correction can be performed while bending of the medium is curbed, and skew correction accuracy can be improved.

Further, as described above, the scanner 1 according to the embodiment includes the feeding roller 14 that feeds the document P placed at the document support unit 11 as the transport roller, and the separation roller 15 that is disposed to face the feeding roller 14 and nips, when a plurality of documents P are placed on top of each other at the document support unit 11, the documents P together with the feeding roller 14 to separate the documents P. As illustrated in FIG. 25A and FIG. 25B, a contact position T4 at which the first load member 190A and the second load member 190B located at the blocking position come into contact with the document P to be transported overlaps the contact position T1 which is the nipping position between the feeding roller 14 and the separation roller 15 when seen in the width direction. The medium such as the document P has higher stiffness as it is closer to the nipping position between the feeding roller 14 and the separation roller 15, and with such a configuration, due to the contact position T4 and the contact position T1 being close to each other, it is possible to perform the skew correction at a position at which the stiffness of the medium is not reduced. Therefore, the scanner 1 of the embodiment can perform the skew correction while the bending of the medium is curbed, and can improve the skew correction accuracy.

Further, as illustrated in FIG. 24A, when the first lever member 180A and the second lever member 180B are located at the advanced position, the first lever member 180A and the second lever member 180B overlap a part of the feeding roller 14 when seen in the width direction. As described above, it is preferable that the first lever member 180A and the second lever member 180B overlap at least a part of the transport roller such as the feeding roller 14 when seen in the width direction when the first lever member 180A and the second lever member 180B are located at the advanced position. With such a configuration, it is possible to arrange the first lever member 180A and the second lever member 180B close to the first load member 190A and the second load member 190B in the feeding direction, and it is possible to correct skew with high accuracy.

As illustrated in FIGS. 21 to 23, the skew correction mechanism 200 according to the embodiment includes a first skew correction unit 200A and a second skew correction unit 200B in the width direction. Here, the first skew correction unit 200A includes the first lever member 180A, a first contact portion 182A, and a first rotating shaft 181A having one end provided with the first lever member 180A and the other end provided with the first contact portion 182A. The first contact portion 182A is displaceable between a first restriction position at which displacement of the first load member 190A from the blocking position to the opening position is restricted and a first non-restriction position at which the restriction is released. In addition, the second skew correction unit 200B includes the second lever member 180B, a second contact portion 182B, and a second rotating shaft 181B having one end provided with the second lever member 180B and the other end provided with the second contact portion 182B. The second contact portion 182B is displaceable between a second restriction position at which displacement of the second load member 190B from the blocking position to the opening position is restricted and a second non-restriction position at which the restriction is released. As illustrated in FIG. 25A, when the first lever member 180A is located at the advanced position, a gap is provided between the first contact portion 182A located at the first restriction position and the first load member 190A located at the blocking position. When the document P being transported presses the first load member 190A, the first load member and the first contact portion 182A come into contact with each other. When the first lever member 180A is located at the retracted position as illustrated in FIGS. 22 and 23, the first contact portion 182A is located at the first non-restriction position. Thus, the first load member 190A becomes displaceable from the blocking position to the opening position, and the leading end Pe of the document P being transported pushes the first load member 190A, whereby the first load member 190A is displaced from the blocking position to the opening position (refer to FIG. 25B and FIG. 25C). Similarly, when the second lever member 180B is located at the advanced position, a gap is provided between the second contact portion located at the second restriction position and the second load member. When the document P being transported presses the second load member 190B, the second load member and the second contact portion 182B come into contact with each other. The second contact portion 182B is located at the second non-restriction position when the second lever member 180B is located at the retracted position. Thus, the second load member 190B becomes displaceable from the blocking position to the opening position, and the leading end of the document P being transported pushes the second load member, whereby the second load member is displaced from the blocking position to the opening position.

As in the skew correction mechanism 200 of the embodiment, it is possible to simply configure the skew correction mechanism 200 by adopting a configuration in which the movements of the lever member 180 and the load member 190 are not directly but indirectly interlocked with each other. In the skew correction mechanism 200 according to the embodiment, since the contact portion 182 (the first contact portion 182A and the second contact portion 182B) is provided, the movements of the lever member 180 (the first lever member 180A and the second lever member 180B) and the load member 190 (the first load member 190A and the second load member 190B) are not directly interlocked with each other. However, a configuration may be adopted in which the load member 190 is also displaced from the blocking position to the opening position in direct conjunction with the displacement of the lever member 180 from the advanced position to the retracted position. That is, the load member 190 (the first load member 190A and the second load member 190B) may be configured to be capable of being displaced from the blocking position to the opening position in accordance with the displacement of the lever member 180 (the first lever member 180A and the second lever member 180B) from the advanced position to the retracted position.

Here, in more detail with reference to FIGS. 21 to 23, the skew correction mechanism 200 according to the embodiment includes the lever member 180, the rotating shaft 181 (the first rotating shaft 181A and the second rotating shaft 181B), the contact portion 182, and the load member 190 in each of the first skew correction unit 200A and the second skew correction unit 200B. Additionally, a guide portion 183 (a first guide portion 183A and a second guide portion 183B) that guides transport of the document in the transport path of the document P, a coil spring 184 (a first coil spring 184A and a second coil spring 184B) that biases the rotating shaft 181 in the rotation direction Rb, and a coil spring 191 (a first coil spring 191A and a second coil spring 191B) that biases the load member 190 in the rotation direction Rb are further provided. Here, as illustrated in FIG. 25B and FIG. 25C, the load member 190 has a rotating shaft 190*a*, and is configured to rotate in the rotation direction Ra by being pressed by the leading end of the document P being transported after the contact portion 182 is displaced from the restriction position to the non-restriction position by the lever member 180 being displaced from the advanced position to the retracted position. Further, the load member 190 is configured to rotate in the rotation direction Rb by a spring force of the coil spring 191 after the trailing end of the document P passes through the load member 190. Since a gap is provided between the contact portion 182 located at the restriction position and the load member 190 located at the blocking position, the contact portion 182 and the load member 190 easily return to the restriction position and the blocking position after the trailing end of the transported document P passes through the load member 190 and the lever member 180.

When the spring force of the coil spring 184 is weak, and the document P is transported and the lever member 180 is pressed by the leading end of the document P, the rotating shaft 181 rotates in the rotation direction Ra. When the rotating shaft 181 rotates in the rotation direction Ra, the contact portion 182 is displaced from the restriction position to the non-restriction position as illustrated in FIG. 25B, and thus the load member 190 is rotates in the rotation direction Ra by being pressed by the leading end Pe of the document P being transported as illustrated in FIG. 25C. Also, after the trailing end of the document P passes the load member 190, the load member 190 rotates in the rotation direction Rb by the spring force of the coil spring 191.

Figure 26C:
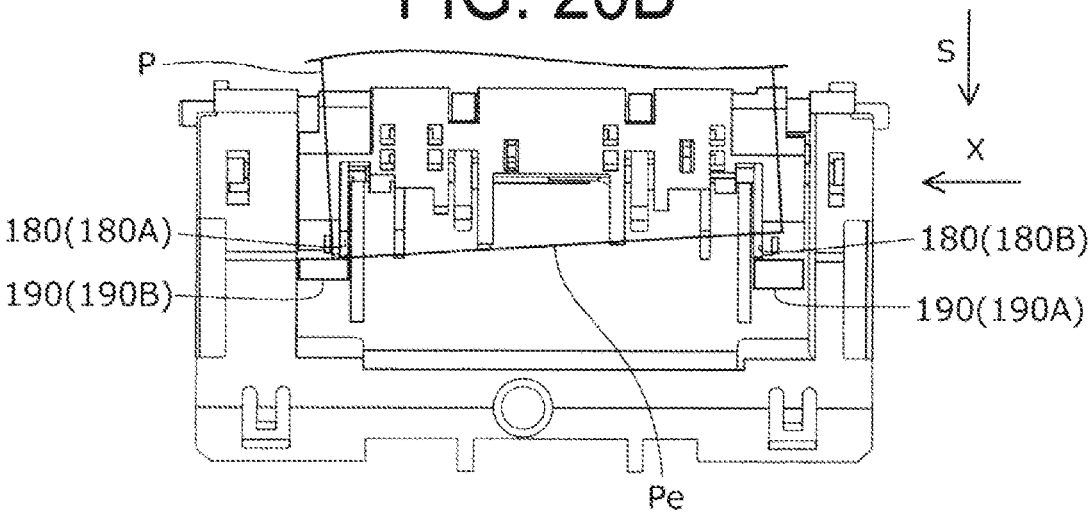
FIG. 26C is a side view illustrating a moment at which the medium collides with a second lever member.

That is, in the skew correction mechanism 200 of the embodiment, when the document P is transported, the leading end Pe of the document P on the leading side in the width direction of the document is detected by the lever member 180, further transport of the document P on the leading side in the width direction of the document is curbed by the load member 190, transport of the document P on the trailing side in the width direction of the document is allowed, and thus the degree of skew is improved. When the leading end Pe of the document P on the trailing side in the width direction of the document is detected by the lever member 180, the transport of the document P is allowed on both sides in the width direction of the device. For example, referring to FIG. 26, the leading end Pe of the document P on the leading side in the width direction of the document is detected by the first lever member 180A. Then, the first load member 190A on the trailing side in the width direction of the document is displaced from the blocking position to the opening position as illustrated in FIG. 26B, and the transport of the document P is continued until the leading end Pe of the document P on the trailing side in the width direction of the document is detected by the second lever member 180B as illustrated in FIG. 26C. At this time, since the second load member 190B on the leading side in the width direction of the document is located at the blocking position, the degree of skew feeding is improved. Then, when the leading end Pe of the document P on the trailing side is detected by the second lever member 180B, the second load member 190B is displaced from the blocking position to the opening position, and the entire document P is transported without being blocked. The outline of the skew correction operation of the skew correction mechanism 200 according to the present embodiment has been described above.

In the scanner 1 of the embodiment, the feeding roller 14 is provided between the first lever member 180A and the second load member 190B and between the second lever member 180B and the first load member 190A in the width direction. That is, the first lever member 180A and the first load member 190A which are separated from each other in the width direction are linked to each other, and the second lever member 180B and the second load member 190B which are separated from each other in the width direction are linked to each other. With such a configuration, it is possible to effectively curb the skew becoming larger than a predetermined angle. In addition, it is possible to effectively correct skew even with respect to the document P having a narrow width by adopting a configuration in which a link destination of the load member 190 with respect to the lever member 180 straddles the feeding roller 14.

Further, as illustrated in FIGS. 21 to 23, the first lever member 180A is provided at a position overlapping a part of the second load member 190B in the feeding direction S, and the second lever member 180B is provided at a position overlapping a part of the first load member 190A in the feeding direction S. In this way, it is preferable that the first lever member 180A is provided at a position overlapping at least a part of the second load member 190B in the feeding direction S, and the second lever member 180B is provided at a position overlapping at least a part of the first load member 190A in the feeding direction S. With such a configuration, it is possible to shorten a distance between the lever member 180 and the load member 190 in the width direction, and it is possible to particularly effectively correct skew even for a document P having a narrow width, for example. In the embodiment, as described above, the lever member 180 is provided at a position overlapping at least a part of the load member 190 in the feeding direction S. However, the lever member 180 may be provided at a position that does not overlap the load member 190 in the feeding direction S, in other words, the first lever member 180A and the second lever member 180B may be provided between the first load member 190A and the second load member 190B in the width direction.

Furthermore, a configuration may be adopted in which a transport roller such as the feeding roller 14 is provided between the first lever member 180A and the first load member 190A and between the second lever member 180B and the second load member 190B in the width direction. In other words, the first lever member 180A and the first load member 190A which are close to each other in the width direction may be linked to each other, and the second lever member 180B and the second load member 190B which are close to each other in the width direction may be linked each other. With such a configuration, it is possible to reduce a size of the link mechanism between the lever member 180 and the load member 190.

The scanner 1 according to the embodiment includes the set guide 153 that guides the leading end Pe of the document P placed at the document support unit 11 to the nipping position between the feeding roller 14 and the separation roller 15, but, as described above, the set guide 153 can adjust a distance between the feeding roller 14 and the separation roller 15 in accordance with the thickness of the document P. The skew correction mechanism 200 is provided in the set guide 153 as illustrated in FIG. 13 and the like. Since the set guide 153 capable of adjusting the distance between the feeding roller 14 and the separation roller 15 in accordance with the thickness of the document P is provided, the distance between the feeding roller 14 and the separation roller 15 is adjusted in accordance with the thickness of the document P, and thus, for example, it is possible to curb a situation in which the document P having a thickness exceeding a predetermined thickness collides with the separation roller 15 and cannot be fed. In addition, since the skew correction mechanism 200 is provided in the set guide 153 and the set guide 153 and the skew correction mechanism 200 are integrated with each other, it is possible to reduce a size of the medium transport device.

In addition, the set guide 153 is disposed on the upstream side of the contact position T1 which is the nipping position in the feeding direction S and is provided at both ends of the feeding roller 14 in the width direction and at positions closer to the feeding roller 14 than the lever member 180 and the load member 190 of the skew correction mechanism 200. The set guide 153 has the pressing lever 157 capable of switching between a first position (refer to FIG. 17) at which the set guide is pressed against the feeding roller 14 and a second position (refer to FIG. 20) at which the set guide is separated from the feeding roller 14 by advancing and retracting with respect to the feeding roller 14. Here, as illustrated in FIG. 20, the pressing lever 157 is configured to press the following medium (the document P2 in FIG. 20) other than the preceding medium among the plurality of documents P placed on top of each other at the first position against the feeding roller 14 after the trailing end in the feeding direction S of the preceding medium (the document P1 in FIG. 20) separated by the separation roller 15 and fed in advance among the plurality of documents P placed on top of each other at the second position passes through the contact position T1. For this reason, the scanner 1 of the embodiment can curb the following medium being strongly returned to the upstream side in the feeding direction S after the preceding medium is fed.

In addition, in the scanner 1 of the embodiment, the guide member 151 that also serves as a path member is disposed in at least a part of the periphery of the separation roller 15 to be opened and closed, is provided so that the separation roller 15 can be detached by being brought into an open state, and forms at least a part of the transport path by being brought into a closed state. The set guide 153 is provided at the guide member 151. The separation roller 15 may be periodically replaced or the like due to a lifetime thereof or the like, and, in the scanner 1 of the embodiment, the separation roller 15 can be easily replaced or the like by bringing the guide member 151 into the open state.

The present disclosure is not intended to be limited to the aforementioned embodiment, and many variations are possible within the scope of the present disclosure as described in the appended claims. It goes without saying that such variations also fall within the scope of the present disclosure. For example, in the scanner 1 of the embodiment, the transport roller that is provided between the first load member 190A and the second load member 190B in the width direction and is provided at a position at which the first load member 190A and the second load member 190B overlap when seen in the width direction when the first load member 190A and the second load member 190B are located at the blocking position is the feeding roller 14. However, instead of the feeding roller 14, a transport roller or the like constituting the first transport roller pair 16, the second transport roller pair 20, or the like may be provided between the first load member 190A and the second load member 190B in the width direction, and may be provided at a position at which the first load member 190A and the second load member 190B overlap when seen in the width direction when the first load member 190A and the second load member 190B are located at the blocking position. In this case, the arrow S corresponds to the transport direction.

In addition, for example, in the scanner 1 of the embodiment, although both the lever member 180 and the load member 190 are provided on the lower side of the transport path of the document P and are configured to advance from the lower side to the upper side, at least one of the lever member 180 and the load member 190 may be provided on the upper side of the transport path of the document P and may be configured to advance from the upper side to the lower side. As in the scanner 1 of the embodiment, when the lever member 180 and the load member 190 are both provided on the lower side of the transport path of the document P and are configured to advance from the lower side to the upper side, it is possible to reduce the risk of the document P slipping through the lever member 180 located at the advanced position and the load member 190 located at the blocking position. On the other hand, when at least one of the lever member 180 and the load member 190 is provided on the upper side of the transport path of the document P and is configured to advance from the upper side to the lower side, the risk of the document P passing through can be reduced by adopting a configuration in which the lever member 180 located at the advanced position and the load member 190 located at the blocking position are lowered to a position beyond the lower surface of the transport path.

In the above-described embodiment, the example in which the present disclosure is applied to an image reading apparatus represented by a scanner has been described, but the present disclosure can also be applied to a recording apparatus represented by a printer. That is, the same effects as those of the above-described embodiment can be obtained in the recording apparatus using the document as a recording medium and using the reading unit as a recording unit that performs recording on the recording medium in the above-described embodiment. An example of the recording apparatus may be an ink jet printer, and an example of the recording unit may be an ink jet recording head.

What is claimed is:

1. A medium feeding device comprising:

a placement unit at which a medium is placed;

a transport path along which the medium is transported;

a feeding roller configured to feed the medium placed at the placement unit; and a skew correction mechanism configured to correct skew of the medium being fed, wherein the skew correction mechanism includes:

a first lever member and a second lever member configured to be displaced between an advanced position at which the first lever member and the second lever member come into contact with the medium and are advanced into the transport path and a retracted position at which the first lever member and the second lever member are retracted from the transport path by the medium passing therethrough in contact therewith; and a first load member and a second load member that are provided downstream of the first lever member and the second lever member in a feeding direction of the medium and are configured to be displaced between a blocking position at which a part of the transport path in a width direction that intersects the feeding direction is blocked and an opening position at which the transport path is opened without being blocked, the feeding roller is provided between the first load member and the second load member in the width direction, the first load member and the second load member, when located at the blocking position, overlap at least a part of the feeding roller when seen in the width direction, the first load member is configured to be located at the blocking position when the first lever member is located at the advanced position and to be displaced from the blocking position to the opening position when the first lever member is located at the retracted position, and the second load member is configured to be located at the blocking position when the second lever member is located at the advanced position and to be displaced from the blocking position to the opening position when the second lever member is located at the retracted position.

2. The medium feeding device according to claim 1, further comprising:

a separation unit disposed to face the feeding roller and configured to, when a plurality of the media are placed on top of each other at the placement unit, nip the media together with the feeding roller to separate the media, wherein a contact position at which the first load member and the second load member located at the blocking position come into contact with the medium being transported and a nipping position between the feeding roller and the separation unit overlap each other when seen in the width direction.

3. The medium feeding device according to claim 1, wherein the first lever member and the second lever member, when located at the advanced position, overlap at least a part of the feeding roller when seen in the width direction.

4. The medium feeding device according to claim 3, wherein the skew correction mechanism includes a first skew correction unit and a second skew correction unit in the width direction, the first skew correction unit includes the first lever member, a first contact portion configured to be displaced between a first restriction position at which displacement of the first load member from the blocking position to the opening position is restricted and a first non-restriction position at which the restriction is released, and a first rotating shaft having one end provided with the first lever member and the other end provided with the first contact portion, the second skew correction unit includes the second lever member, a second contact portion configured to be displaced between a second restriction position at which displacement of the second load member from the blocking position to the opening position is restricted and a second non-restriction position at which the restriction is released, and a second rotating shaft having one end provided with the second lever member and the other end provided with the second contact portion, the first contact portion is located at the first restriction position when the first lever member is located at the advanced position, and is located at the first non-restriction position when the first lever member is located at the retracted position, and the second contact portion is located at the second restriction position when the second lever member is located at the advanced position, and is located at the second non-restriction position when the second lever member is located at the retracted position.

5. The medium feeding device according to claim 4, wherein the feeding roller is provided between the first lever member and the second load member, and the second lever member and the first load member in the width direction.

6. The medium feeding device according to claim 5, wherein the first lever member is provided at a position overlapping at least a part of the second load member in the feeding direction, and the second lever member is provided at a position overlapping at least a part of the first load member in the feeding direction.

7. The medium feeding device according to claim 4, wherein the feeding roller is provided between the first lever member and the first load member, and the second lever member and the second load member in the width direction.

8. The medium feeding device according to claim 1, further comprising:

a separation unit disposed to face the feeding roller and configured to, when a plurality of the media are placed on top of each other at the placement unit, nip the media together with the feeding roller to separate the media; and a set guide configured to guide a leading end of the medium placed at the placement unit to a nipping position between the feeding roller and the separation unit, wherein the set guide is configured to adjust a distance between the separation unit and the feeding roller according to a thickness of the medium, and the skew correction mechanism is provided in the set guide.

9. The medium feeding device according to claim 8, wherein the set guide includes a pressing lever disposed upstream of the nipping position in the feeding direction, provided at both ends of the feeding roller in the width direction at positions closer to the feeding roller than the skew correction mechanism, and configured to switch between a first position for pressing on the feeding roller and a second position for separating from the feeding roller by advancing and retracting with respect to the feeding roller, and the pressing lever is configured to, after a trailing end in the feeding direction of a preceding medium separated by the separation unit and fed in advance among the plurality of media placed on top of each other at the second position passes through the nipping position, press a following medium other than the preceding medium among the plurality of media placed on top of each other at the first position against the feeding roller.

10. The medium feeding device according to claim 8, further comprising a path member openably and closably disposed in at least a part of a periphery of the separation unit is provided so that the separation unit is configured to be detached when the path member is in an open state, and forms at least a part of the transport path when the path member is in a closed state, wherein the set guide is provided at the path member.

11. The medium feeding device according to claim 9, further comprising:

a path member openably and closably disposed in at least a part of a periphery of the separation unit is provided so that the separation unit is configured to be detached when the path member is in an open state, and forms at least a part of the transport path when the path member is in a closed state, wherein the set guide is provided at the path member.

12. An image reading apparatus comprising the medium feeding device according to claim 1; and a reading unit configured to read an image on the medium transported on the transport path.

* * * * *